US011835293B2

(12) United States Patent
Alderete

(10) Patent No.: US 11,835,293 B2
(45) Date of Patent: Dec. 5, 2023

(54) METHODS AND SYSTEMS FOR HYDRATION BLADDER DRYING

(71) Applicant: TRL-9, LLC, Albuquerque, NM (US)

(72) Inventor: Steven Alderete, Albuquerque, NM (US)

(73) Assignee: TRL-9, LLC, Albuquerque, NM (US)

( * ) Notice: Subject to any disclaimer, the term of this patent is extended or adjusted under 35 U.S.C. 154(b) by 270 days.

(21) Appl. No.: 17/306,591

(22) Filed: May 3, 2021

(65) Prior Publication Data

US 2021/0254893 A1 Aug. 19, 2021

Related U.S. Application Data

(63) Continuation-in-part of application No. 16/006,607, filed on Jun. 12, 2018, now Pat. No. 10,995,987.

(60) Provisional application No. 62/683,930, filed on Jun. 12, 2018, provisional application No. 62/525,890, filed on Jun. 28, 2017.

(51) Int. Cl.
*F26B 21/00* (2006.01)

(52) U.S. Cl.
CPC ..... *F26B 21/008* (2013.01); *F26B 21/001* (2013.01)

(58) Field of Classification Search
CPC ..... F26B 21/008; F26B 21/001
See application file for complete search history.

(56) References Cited

U.S. PATENT DOCUMENTS

| | | | | |
|---|---|---|---|---|
| 2,943,771 | A | 7/1960 | Driscoll | |
| 5,214,860 | A | 6/1993 | Landes | |
| 5,713,137 | A * | 2/1998 | Fujita | F26B 9/006 34/106 |
| 6,134,806 | A * | 10/2000 | Dhaemers | F26B 9/006 34/235 |
| 7,568,673 | B2 | 8/2009 | Evingson | |
| 8,024,870 | B1 | 9/2011 | Ballentine et al. | |
| 8,177,097 | B2 | 5/2012 | Duran | |
| 8,356,422 | B1 | 1/2013 | Ballentine et al. | |
| 8,591,486 | B2 * | 11/2013 | Locke | A61M 1/71 604/319 |
| 8,595,951 | B2 | 12/2013 | Peet | |
| 9,044,521 | B2 * | 6/2015 | Farren | A61L 2/10 |
| 9,358,316 | B2 * | 6/2016 | Leyva | A61M 16/16 |
| 10,591,198 | B2 * | 3/2020 | Abeygunawardana | F25D 17/062 |
| 10,980,905 | B2 * | 4/2021 | Bohman | C01B 13/11 |
| 2004/0244216 | A1 | 12/2004 | Poole | |
| 2005/0160617 | A1 | 7/2005 | Fouts | |
| 2006/0163284 | A1 | 7/2006 | Karl | |
| 2007/0261263 | A1 | 11/2007 | Lee | |
| 2013/0212900 | A1 * | 8/2013 | Stewart | F26B 3/283 34/275 |

(Continued)

*Primary Examiner* — Jessica Yuen
(74) *Attorney, Agent, or Firm* — LOZA & LOZA, LLP; Kevin L. Soules

(57) ABSTRACT

A system, method, and apparatus for drying a hydration system comprises an airflow apparatus comprising a case, a heating element, a fan, a cap for a hydration bladder cap comprising a fluidic connection to bladder and air flow apparatus, a conduit connected to cap and airflow apparatus, conduit further comprising an exhaust vent, a clip connected to a mouthpiece associated with bladder wherein airflow apparatus produces airflow through bladder and mouthpiece, and a rack configured to hold hydration bladder while airflow flow through bladder and mouthpiece.

20 Claims, 22 Drawing Sheets

(56) References Cited

U.S. PATENT DOCUMENTS

2017/0292787 A1* 10/2017 Denton ..... F26B 9/003

* cited by examiner

METHODS AND SYSTEMS FOR HYDRATION BLADDER DRYING

CROSS REFERENCE TO RELATED PATENT APPLICATIONS

This application is a Continuation in Part of U.S. application Ser. No. 16/006,607, entitled "METHODS AND SYSTEMS FOR HYDRATION BLADDER DRYING," filed on Jun. 12, 2018. Application Ser. No. 16/006,607 is incorporated herein by reference in its entirety.

U.S. patent application Ser. No. 16/006,607 and this patent application, claim the priority and benefit under 35 U.S.C. § 119(e) of U.S. Provisional Patent Application Ser. No. 62/525,890 filed Jun. 28, 2017, entitled "METHODS AND SYSTEMS FOR HYDRATION BLADDER DRYING." U.S. Provisional Patent Application Ser. No. 62/525,890 is herein incorporated by reference in its entirety.

U.S. patent application Ser. No. 16/006,607 and this patent application, also claims the priority and benefit under 35 U.S.C. § 119(e) of U.S. Provisional Patent Application Ser. No. 62/683,930 filed Jun. 12, 2018, entitled "METHODS AND SYSTEMS FOR HYDRATION BLADDER DRYING." U.S. Provisional Patent Application Ser. No. 62/683,930 is herein incorporated by reference in its entirety.

TECHNICAL FIELD

Embodiments generally relate to hydration systems. Embodiments also relate to hydration system bladders.

Embodiments further relate to drying systems and methods for hydration bladders. More specifically, embodiments relate to specially designed systems and methods to introduce ambient or heated air flow into hydration bladders in order to remove liquid remnants from the bladder. Embodiments are thus related to methods and systems for drying and/or sanitizing hydration bladder systems.

BACKGROUND

Outdoor enthusiasts have embraced the use of hydration systems integrated in backpacks. Backpack hydration systems generally include a bladder, hose and mouthpiece. The system provides a convenient means for storing, transporting, and dispensing drinking water when performing outdoor activities, where a potable water supply is unavailable or otherwise inconvenient to access.

However, conventional hydration systems suffer from a number of drawbacks. First, once the activity is done, the hydration system requires cleaning and/or disinfecting in order to keep the system sanitary and ready for subsequent use. Failure to properly clean the hydration system may result in the development of mold, or other water borne organisms, in the hydration system components. This can result in unpleasant odors, and may be hazardous to a user's health.

Washing/cleaning the hydration system, which is a relatively straightforward process, generally will not prevent mold. Instead, ensuring the system properly dries, is the chief requirement in mold prevention. Because most hydration systems include a soft-sided reservoir, they are often difficult and time consuming to dry. The walls tend to collapse on themselves and can stick together as a result of pooling liquid droplets.

Prior art approaches to cleaning can be found as kits which provide tools such as brushes, cleaning solution, hangers, etc. However, these kits do not offer sufficient means for adequately drying the components of the system. Other approaches include the use of chemicals for cleaning and hanger systems for drying. These approaches are time intensive, require awkward hangers, tools and/or chemicals, and still do not guarantee components of the hydration system will be sufficiently dry and clean.

Accordingly, there is a need in the art for systems and methods for drying the components of a hydration system as disclosed herein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide a method and system for drying hydration system components.

It is, another aspect of the disclosed embodiments to provide a method and system for drying liquid reservoirs associated with hydration systems.

It is another aspect of the disclosed embodiments to provide a method and system for providing ambient and/or heated airflow within components of a hydration system to expedite drying of the constituent components.

It will be appreciated that the methods and systems can be achieved according to the embodiments disclosed herein. In one such embodiment, a system, method, and/or apparatus comprises an airflow apparatus comprising a case, a heating element, a fan, and a cap for a hydration bladder. The cap provides a fluidic connection between the bladder and the air flow apparatus. The system includes a conduit connected to the cap and the airflow apparatus, the conduit further comprising an exhaust vent. A clip can be connected to a mouthpiece associated with the bladder wherein the airflow apparatus produces airflow through the bladder, the tube, and the mouthpiece. The embodiments can further include a rack configured to hold the hydration bladder while air flows through the bladder, tube and mouthpiece. In an embodiment the cap further comprises an exhaust vent wherein a size of an opening associated with the exhaust vent can be adjusted.

BRIEF DESCRIPTION OF THE FIGURES

The accompanying figures, in which like reference numerals refer to identical or functionally-similar elements throughout the separate views, which are incorporated in and form a part of the specification, further illustrate the embodiments and, together with the detailed description, serve to explain the embodiments disclosed herein.

DETAILED DESCRIPTION

Figure 1A:
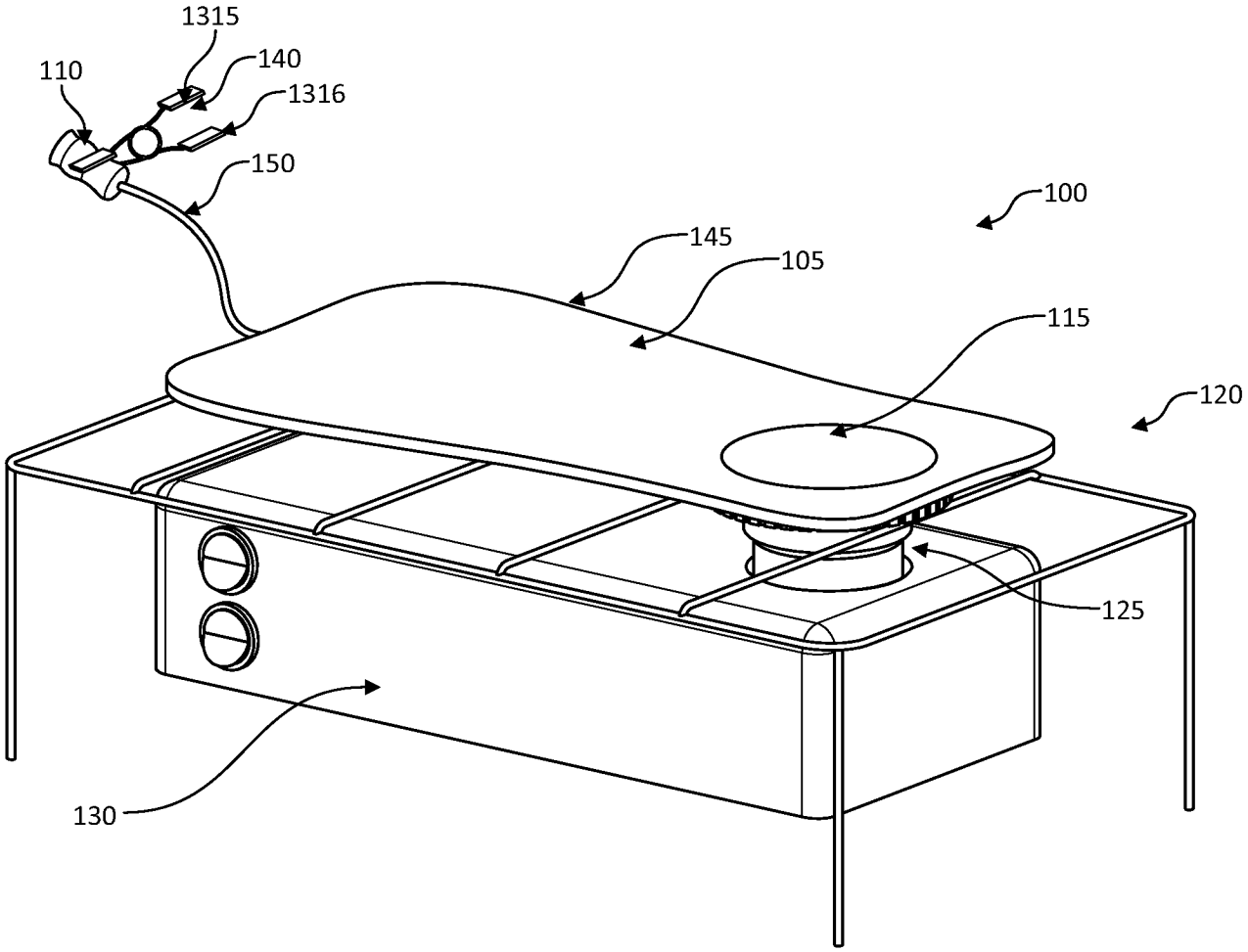
FIG. 1A depicts a block diagram of a drying system for a hydration bladder in accordance with the disclosed embodiments.

The particular values and configurations discussed in these non-limiting examples can be varied and are cited merely to illustrate one or more embodiments and are not intended to limit the scope thereof.

Example embodiments will now be described more fully hereinafter, with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

FIG. 1 illustrates an embodiment of a system 100 for drying components of a general hydration assembly 145. The system 100 is formed to facilitate the drying of hydration systems 145 and to promote safe storage of such systems. The system 100 includes a specially designed cap 115 configured to interface with the existing fitting in the hydration bladder 105.

It should be appreciated that a hydration system bladder typically includes an opening that allows the reservoir to be filled with liquid. The reservoir generally includes a threaded fitting along the circumference of the opening and a stock threaded cap that can be twisted into the fitting to seal the bladder once it has been filled with liquid. The system disclosed herein can include a cap, such as cap 115, that can be configured in a number of ways. Certain embodiments of such a cap (configured for example to interface with a Camel Back® hydration bladder, an MSR® hydration system, an OutDoor® hydration bladder, a general hydration system, etc.) are illustrated. In these embodiments, the cap 115 is configured to properly engage with the fitting in the hydration bladder and/or replace the stock cap provided with the hydration system during operation of the system to dry the hydration system.

The cap 115 can generally include an opening that connects to a bladder coupler 125. The bladder coupler 125 can be embodied as a conduit or sleeve that connects the bladder 105 to a blower and/or heater unit 130. The cap 115 may further include a vent to allow air to exit the bladder 105. In addition, a clip 140 is provided that can be used to hold open a mouthpiece 110 associated with the tube 150 running from the bladder 105 to the mouthpiece 110. In certain embodiments, the hydration system 145 can be held on a rack system 120.

A critical aspect of the system 100 is that cap 115 can engage with the existing bladder 105 opening and fitting. It should be appreciated that the cap 115 can be configured in various ways and can be configured to be compatible with various hydration systems which have different openings and fittings.

Figure 1B:
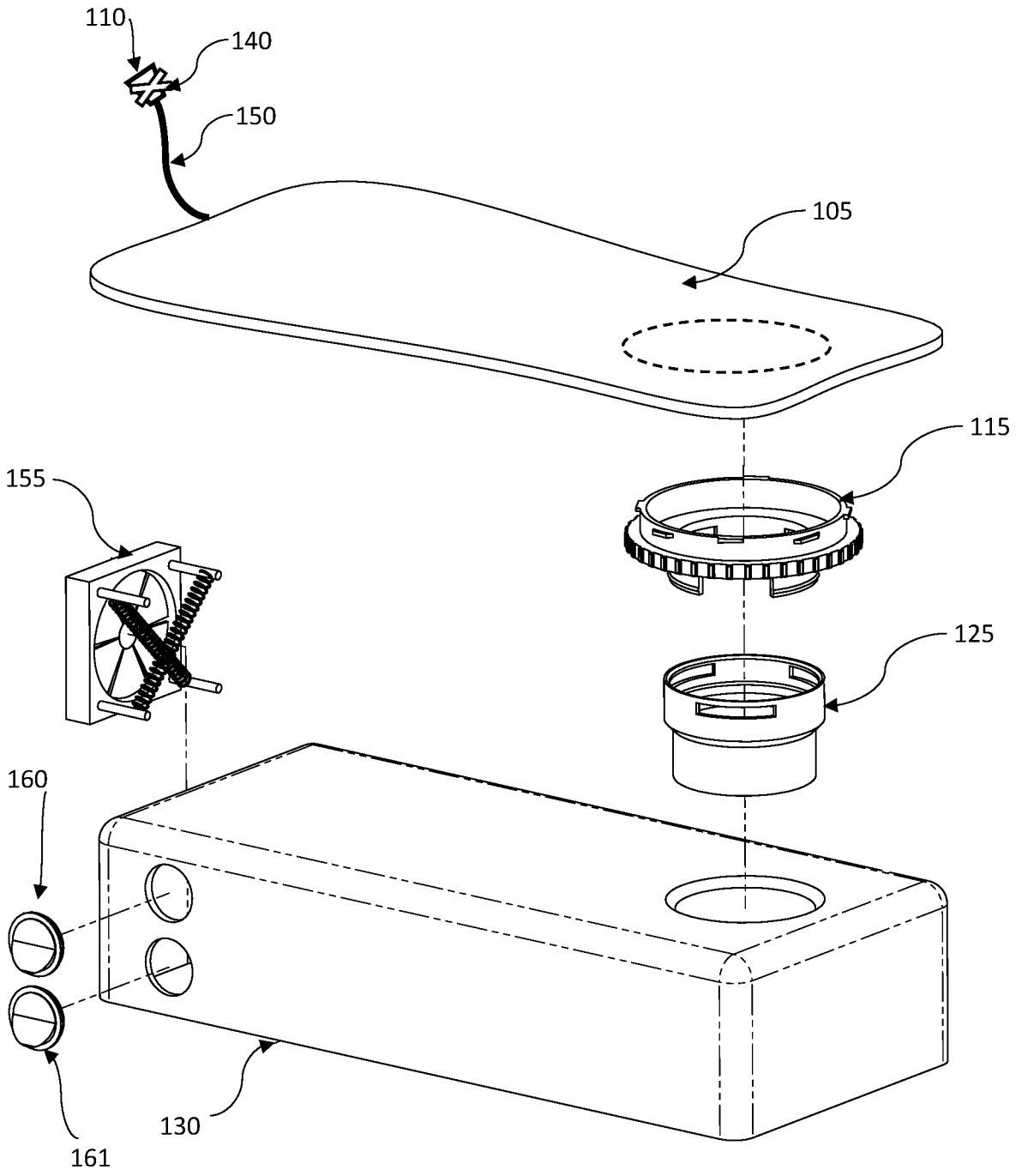
FIG. 1B depicts a block diagram of a drying system for a hydration bladder in accordance with the disclosed embodiments.

FIG. 1B illustrates an embodiment of the system 100. The bladder coupler 125 connects the cap 115 to the heater and/or blower unit 130. Once the cap 115 is connected to the bladder coupler 125 and the bladder 105, and the bladder coupler 125 is connected to the heater and/or blower unit 130. In certain embodiments, the clip 140 can be connected to the mouthpiece 110. This creates an open fluidic path between the blower unit 130 and the mount piece 110. The heater and/or blower 130 forces air through the bladder coupler 125, cap 115 and into the hydration bladder 105. In this embodiment the heater and/or blower 130 is further illustrated with a heating and blowing element 155, and switch 160 to control power to a fan, and switch 161 configured to control power to a heating element (such as electric heating coils).

The air flows through the hydration bladder 105, tube 150, and out the open mouthpiece 110. The airflow facilitates convection and/or evaporation, which rapidly dries the interior of the hydration bladder 105, hose 150, mouthpiece 140, and other components. A vent in the cap 115, or a vent in the bladder coupler 125, both of which are further detailed herein, may be opened and adjusted to allow for inflation of the hydration bladder while maintaining even airflow, in certain embodiments. Once the interior of the hydration system 145 is fully dry, the cap 115 can be replaced by the stock cap provided with the hydration bladder 105. The hydration system 145 is now in condition for use, or safe storage until future use.

The embodiment illustrated in FIG. 1B shows the system 100 configured for drying a hydration system using a Camelback® hydration bladder, or other hydration bladder using a substantially similar cap and opening design. As illustrated, the bladder 105 can connected to cap 115. The cap 115 connects to the heater and/or blower 130 via bladder coupler 125

Figure 2A:
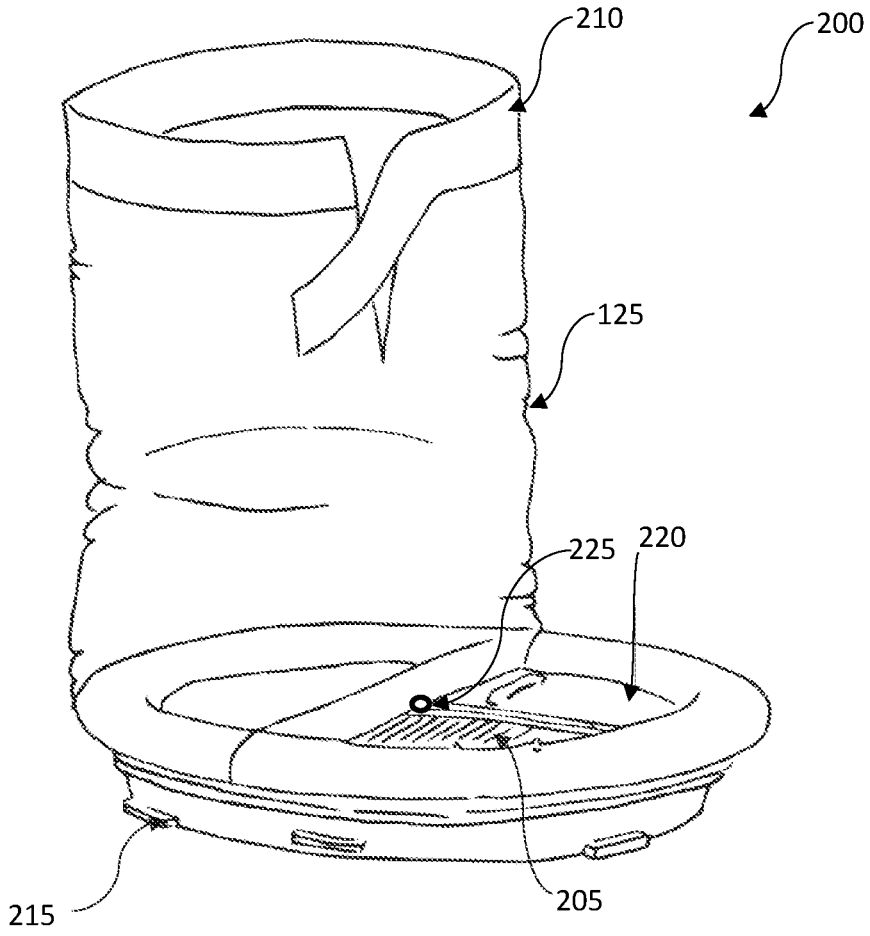
FIG. 2A depicts a cap and bladder coupler in accordance with the disclosed embodiments.

FIG. 2A illustrates an embodiment of a cap designed for use with a Camelback® hydration bladder, or other hydration bladder using a substantially similar cap and opening design. In these embodiments, the cap 115 is embodied as a specialized cap 200, that generally comprises threading 215 or other such connective means configured to engage with the threaded fitting formed in the opening of the bladder.

In FIG. 2A, the opening in the cap associated with exhaust valve 205, can be manually opened or closed via door 220 that is configured in the cap 200 in a plane parallel to the cap surface. The door 220 is configured on the inside of the cap 200. The exhaust valve door 220 can pivot around a pin 225 located at the center of the cap 200 that penetrates both the outer surface of the cap 200 and the door 220. The pin 225 is configured to hold the cap and door assembly in place but the pin 225 does not penetrate past the door in order to prevent unwanted breaches of the bladder.

FIG. 2A further illustrates an embodiment of bladder coupler 125, that incorporates a slit end and fastening member that can be adjusted to allow the diameter of the conduit to fit the blower. The fastening member can be a hook and loop fastener 210 that can be used to secure the bladder coupler to the blower and/or heater.

Figure 2B:
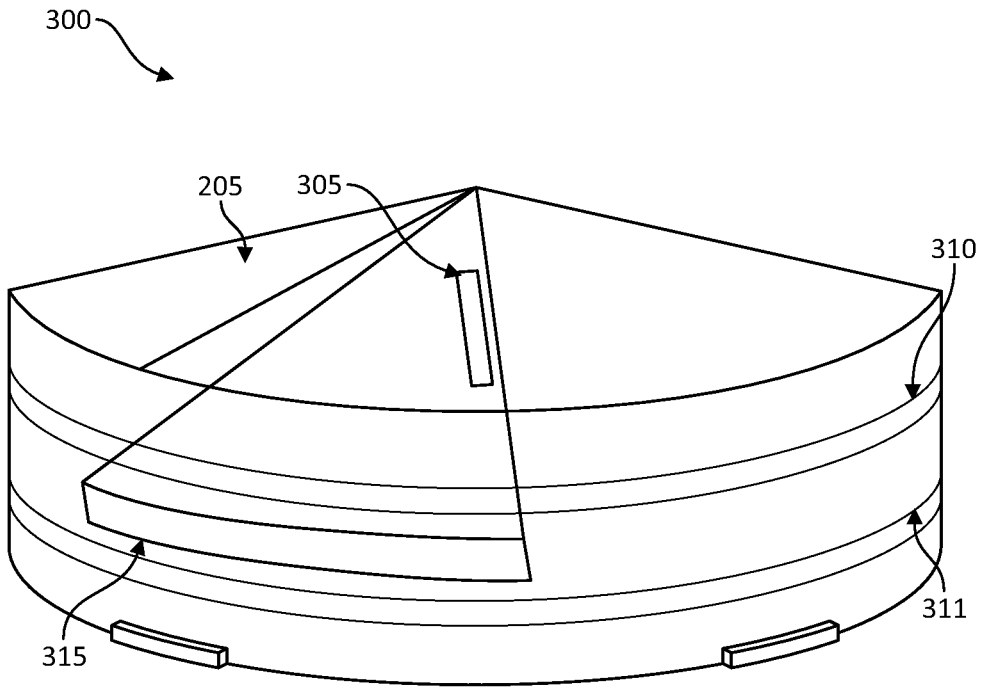
FIG. 2B depicts another embodiment of a cap in accordance with the disclosed embodiments.

Another embodiment of a cap 115 is embodied as a specialized cap 300, which is illustrated in FIG. 2B. Cap 300 is designed for use with a Camelback® hydration bladder, or other hydration bladder using a substantially similar cap and opening design. In this embodiment, the cap 300 includes a door 315 that can be used to open and close the exhaust valve 205. In this embodiment, the door 315 can slide interior to the cap 300 between an upper rail 310 and lower rail 311. The door 315 can include a thumb guide 305 to make manipulation of the door 315 simple. As with the other embodiments, the cap 300 can be configured to connect to the stock opening and fitting of a hydration bladder, such as bladder 105.

Figure 2C:
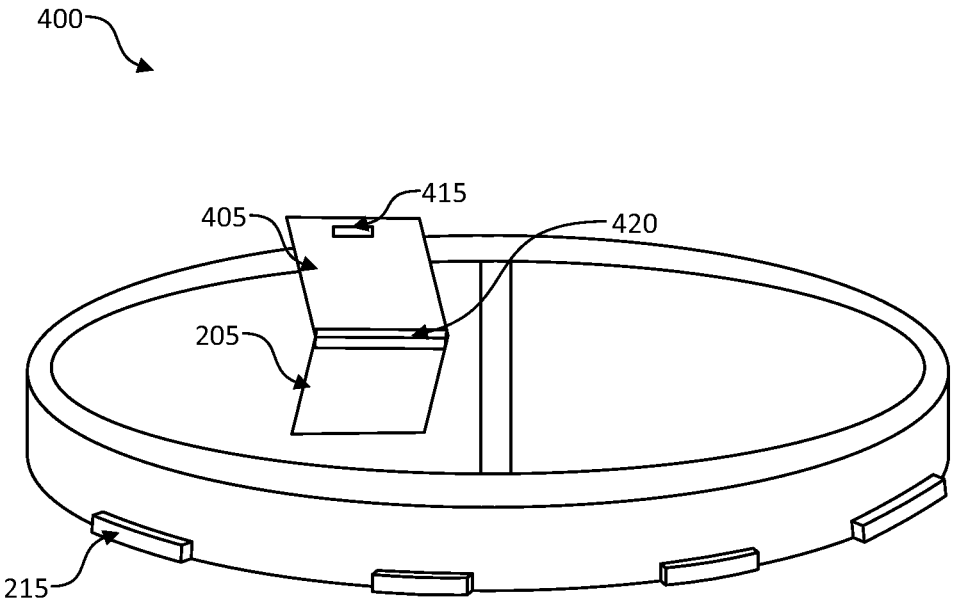
FIG. 2C depicts another embodiment of a cap in accordance with the disclosed embodiments.

FIG. 2C illustrates another embodiment of a cap 115 configured as a specialized cap 400. In this embodiment, the cap 400 includes a door 405 that can be used to open and close the exhaust valve 205, by lifting the door 405. In this embodiment, the door 405 can open like a trap door and is connected to the exhaust vent 205 by hinge 420. The door 405 can include a rotating thumb lock 415 to make manipulate of the door 405 simple. The door 405 can be sufficiently locked into place with the rotating thumb lock 415 and can be sealed when closed with a sealing material such as rubber or plastic configured around the rim of the opening and/or hinged door 405. As with the other embodiment's the cap 115 can be configured to connect to the stock opening and fitting of a hydration bladder, such as bladder 105.

Figure 2D:
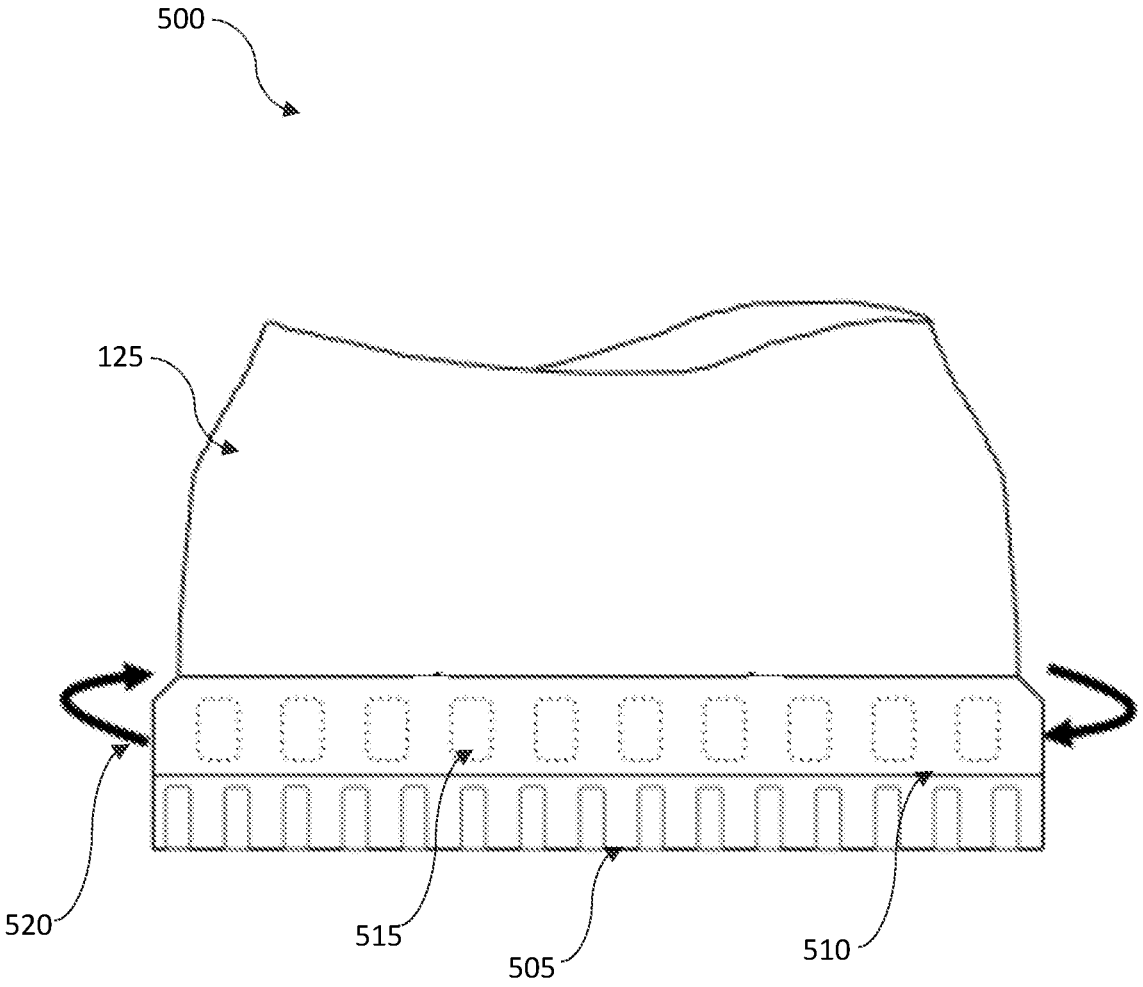
FIG. 2D depicts another embodiment of a cap and bladder coupler in accordance with the disclosed embodiments.

FIG. 2D illustrates yet another embodiment of cap 115 is embodied as a specialized cap 500. Cap 500 is designed for use with a Camelback® hydration bladder, or other hydration bladder using a substantially similar cap and opening design. In this embodiment, the cap 500 is configured with internal male and female threads on an inner lip 505 and outer lip 510 respectively, that allow the user to "twist" the inner lip 250 to reveal small openings 515 that serve as exhaust openings in the cap 500.

For example, the cap 500 illustrated in FIG. 2D includes inner lip 505 and outer lip 510, each having one or more openings 515. Once the cap 500 is affixed to the hydration bladder, the user can twist the outer lip 510 'clockwise' as shown by arrow 520 until the engaged threads stop the twisting motion, revealing the openings 515. It should be appreciated that the openings 515 may span a small portion of the radius of the cap 500, or may be disposed throughout the entire radius of the cap 500 as shown. Twisting the outer cap 500 'counterclockwise' will close the openings. As with the other embodiments, the cap 500 can be configured to connect to the stock opening and fitting of a hydration bladder, such as bladder 105.

Figure 2E:
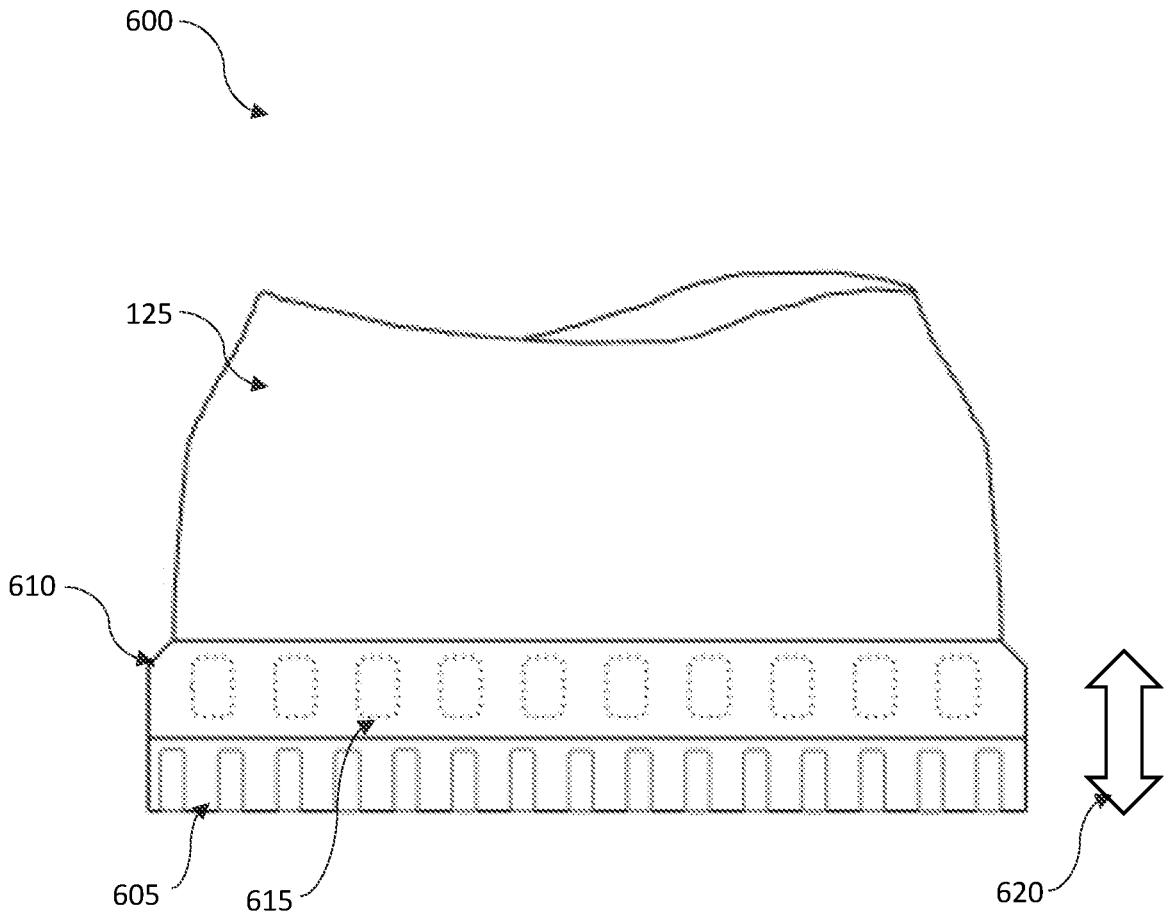
FIG. 2E depicts another embodiment of a cap and bladder coupler in accordance with the disclosed embodiments.

In another embodiment, the cap 115 is embodied as a specialized cap 600. Cap 600 is designed for use with a Camelback® hydration bladder, or other hydration bladder using a substantially similar cap and opening design. Cap 600 illustrated in FIG. 2E includes lower cap 605 and upper cap 610, each having one or more openings 615. Once the cap 600 is affixed to the hydration bladder, the user can "pop down" the lower cap 605, as shown by arrow 620, to reveal small openings 615 in the upper cap 610. Again, this system will have two integrated caps, each having small openings. Once the cap is affixed to the hydration bladder, the user can pull the lower cap down until it 'pops' down, revealing one or more small openings disposed across some, or throughout the entire, circumference of the cap. The user can then push the upper cap up until it 'pops' back into the closed position.

Figure 2F:
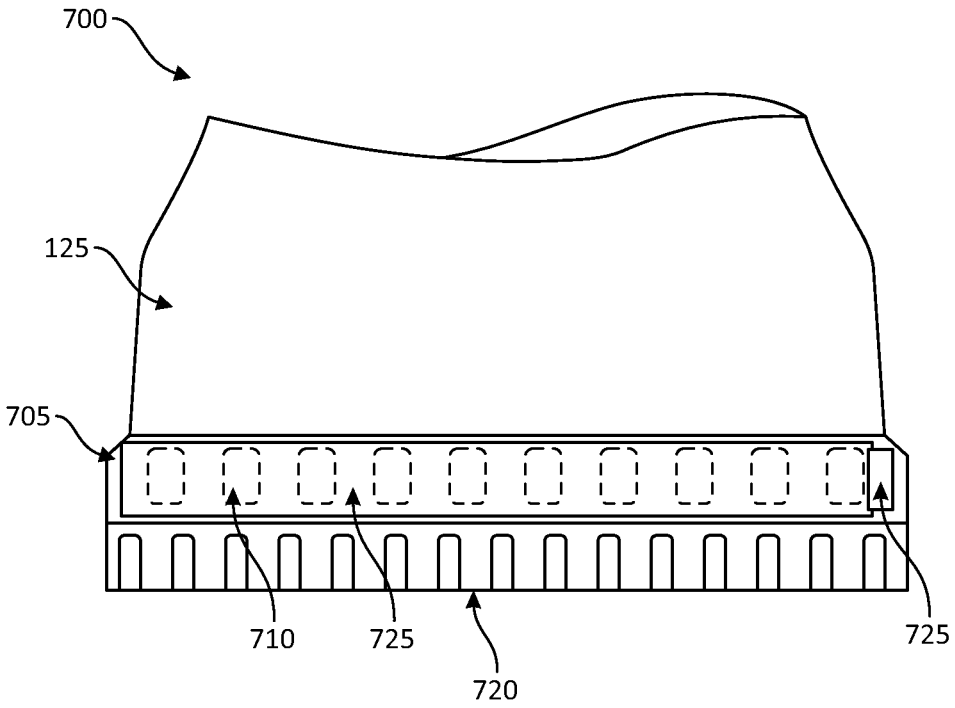
FIG. 2F depicts another embodiment of a cap and bladder coupler in accordance with the disclosed embodiments.

Another embodiment, illustrated in FIG. 2F includes a cap 115 embodied as a specialized cap 700. Cap 700 is designed for use with a Camelback® hydration bladder, or other hydration bladder using a substantially similar cap and opening design. Cap 700 comprises a configuration of nested caps 705, the user can "twist" to reveal small openings 710 that serve as exhaust openings in the cap 700. In this embodiment the cap 700 can have two integrated caps, inner cap 715 and outer cap 720, each having one or more openings. Once the cap is affixed to the hydration bladder, the user can twist the outer cap 720 'clockwise' until a thumb stop 725 impedes the twisting motion, revealing the openings. It should be appreciated that the openings may span a small portion of the radius of the cap or may be disposed throughout the entire radius of the cap. Twisting the outer cap 720 'counterclockwise' will close the openings, again using a thumb stop 725 to impede the ring from traveling further. The exhaust valve can be guided along its path by one or more rails built into the cap, as illustrated in FIG. 2B.

Figure 2G:
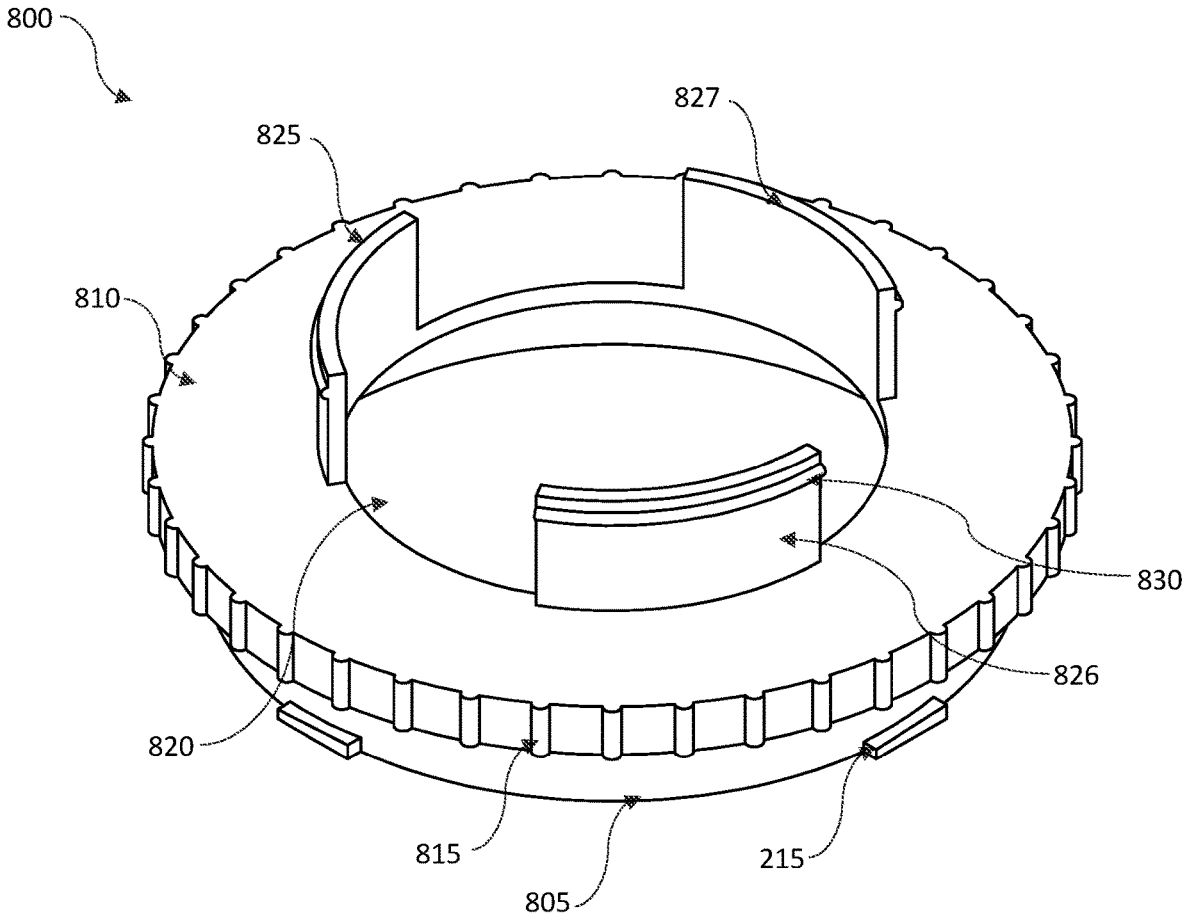
FIG. 2G depicts another embodiment of a cap in accordance with the disclosed embodiments.

FIG. 2G illustrates an exemplary embodiment of a cap 115 embodied as a specialized cap 800. Cap 800 is designed for use with a Camelback® hydration bladder, or other hydration bladder using a substantially similar cap and opening design.

In this embodiment cap 800 includes threading 215 formed on an engaging ring 805 that is formed to fit the Camelback® hydration bladder fitting. A larger grip ring 810, with a series of grips 815 is formed on the top of the engaging ring 805. The grips 815 are provided as protrusions and/or intrusions in the grip ring 810 that facilitate user engagement with the cap 800.

The cap 800 further includes an opening 820. The opening serves as the conduit through with air can pass between the bladder coupling and heater/blower. A series of connection fins 825, 826, and 827 are formed around the opening 820. The connection fins 825, 826, and 827 include a connection rim 830, that serves as the connection interface between the cap 800 and the bladder coupling. In certain embodiments a specially designed bladder coupling, further detailed herein, is formed to engage the connection fins 825, 826, and 827 associated with cap 800. It should be noted that FIG. 2G illustrates an embodiment with only three fins, but other numbers of connection fins could be used in other embodiments.

Figure 3:
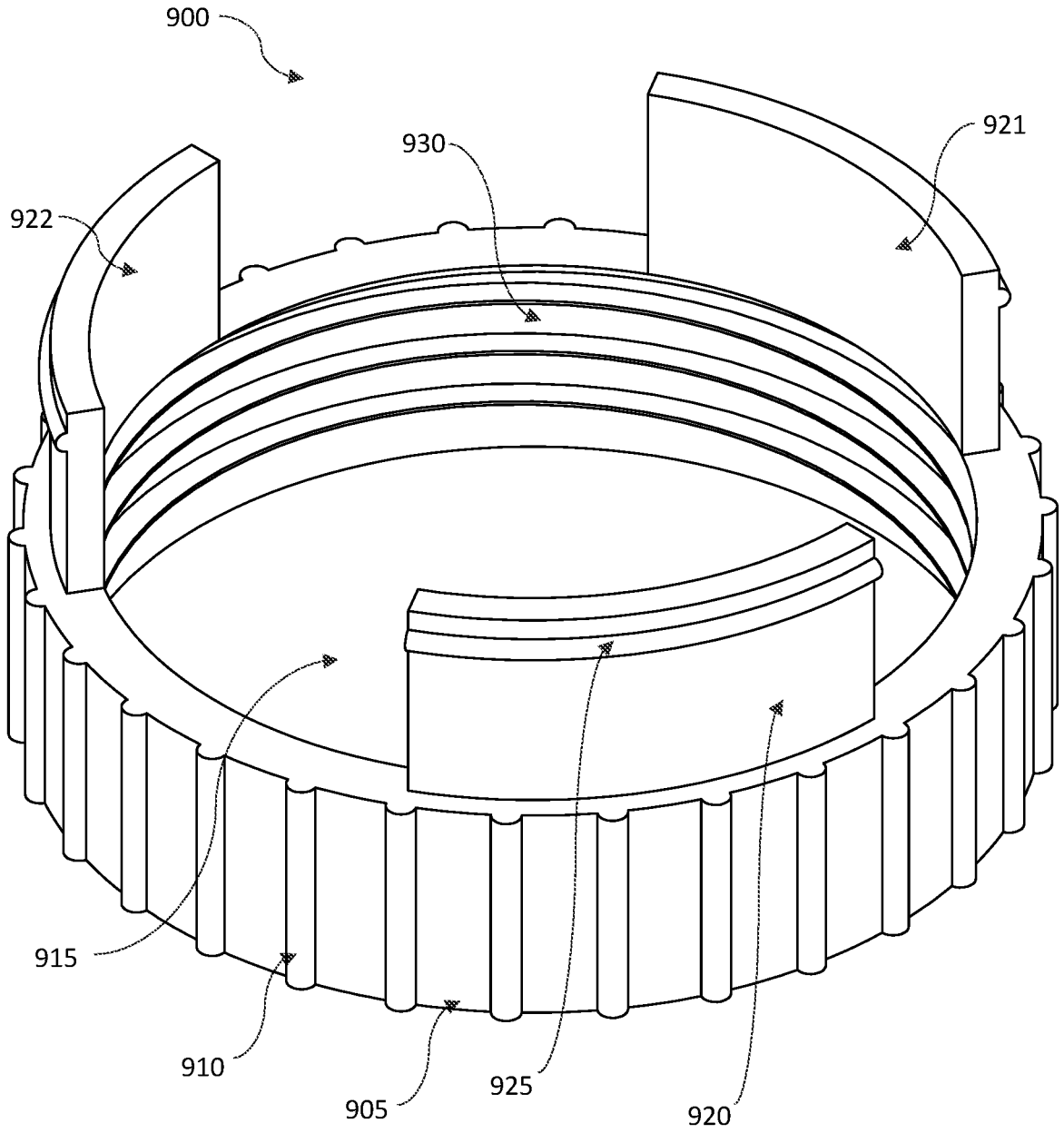
FIG. 3 depicts another embodiment of a cap in accordance with the disclosed embodiments.

FIG. 3 illustrates an exemplary embodiment of a cap 900 that can be used in conjunction with an MSR® hydration bladder, or other hydration bladder using a substantially similar cap and opening design. The cap 900 includes threading 930 formed on the interior of the cap ring 905 that is formed to fit the MSR® hydration bladder fitting. The cap ring 905 includes a series of grips 910. The grips 910 are provided as protrusions and/or intrusions in the cap ring 905 that facilitate user engagement with the cap 900.

The cap 900 further includes an opening 915. The opening 915 serves as the conduit through with air can pass between the bladder coupling and heater/blower. A series of connection fins 920, 921, and 922 are formed around the opening 915. The connection fins 920, 921, and 922 include a connection rim 925, that serve as the connection interface between the cap 900 and the bladder coupling. In certain embodiments a specially designed bladder coupling, further detailed herein, is formed to engage the connection fins 920, 921, and 922 associated with cap 900. It should be noted that FIG. 3 illustrates an embodiment with only three fins, but other numbers of connection fins could be used in other embodiments.

Figure 4:
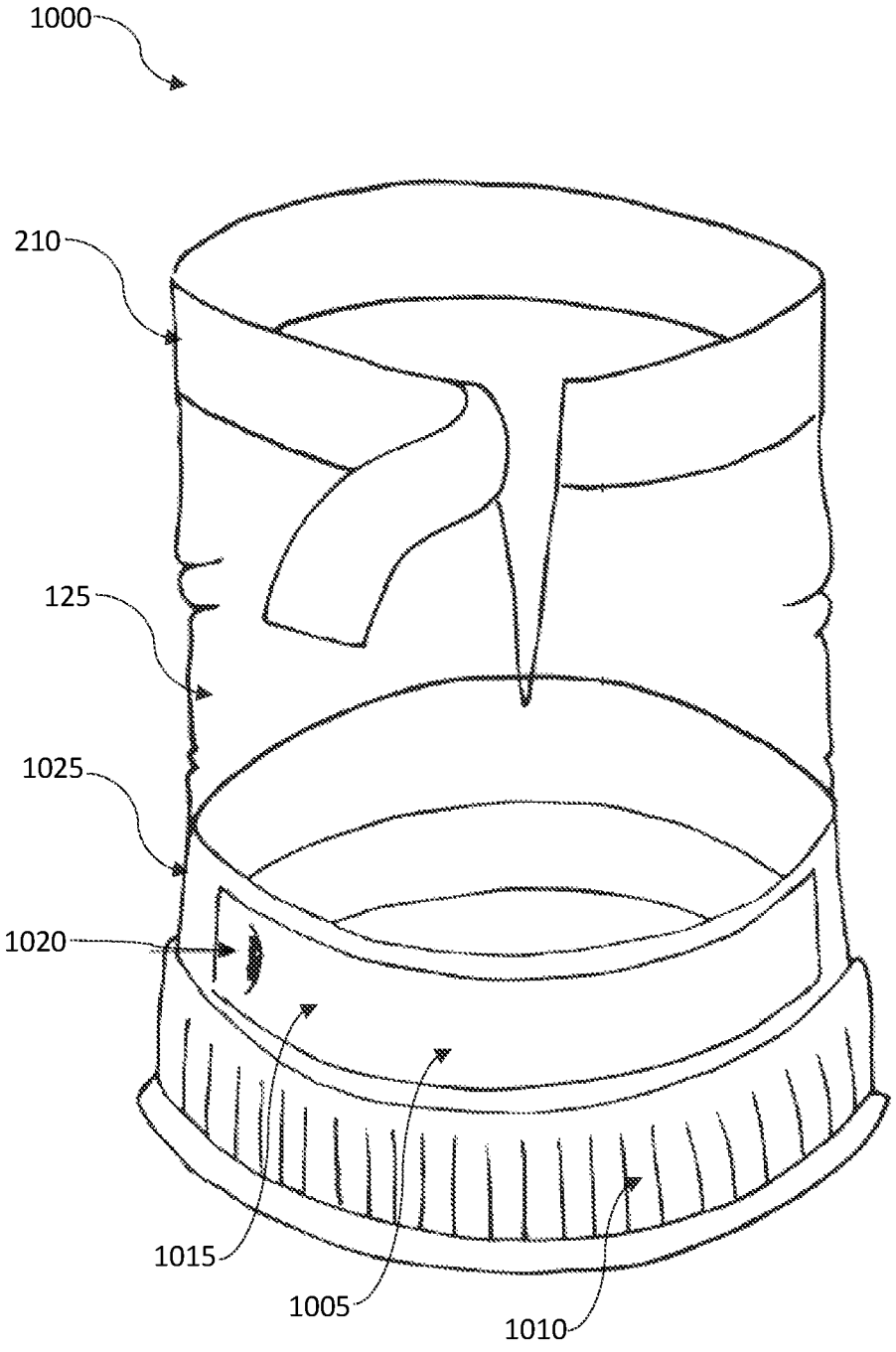
FIG. 4 depicts another embodiment of a cap and bladder coupler in accordance with the disclosed embodiments.

In another embodiment, another cap 1000, illustrated in FIG. 4, is configured for use with the Outdoor® hydration bladder, or other hydration bladder using a substantially similar cap and fitting design. This cap 1000 generally comprises threading, or other such connective means, configured in cap rim 1010 to engage with the threaded fitting formed in the opening of the bladder. The cap 1000 can be constructed with a vertical rim 1025 in order to accommodate the exhaust valve 1005.

The exhaust valve 1005 can be integrated into the vertical rim 1025. The opening in cap 1000, or exhaust valve 1005, can be manually opened or closed via a rotating door 1015 built into the vertical rim 1025 of the cap 1000. The exhaust valve door 1015 can be guided along its path inside the rim 1025 of the cap 1000 by one or more rails built into the vertical rim 1025 of the cap 1000. A small thumb hold 1020 formed on the exterior of the rotating door 1015, is configured to allow the operator to adjust the opening in the exhaust valve 1005 and also acts as a 'stop' once the exhaust valve 1005 has been moved to a fully opened or fully closed position.

The exhaust valve integrated into the cap in the various embodiments is of vital importance. Once the bladder is inflated using a blower or hair dryer, the exhaust valve can be adjusted to keep the bladder inflated and prevent rupturing of the bladder. This can be accomplished by simply adjusting the exhaust valve appropriately. The exhaust valve can have physical stops designed into the door in order to keep the exhaust valve open and to prevent the user from sliding it beyond its functional design.

It should be appreciated that while the various embodiments of the cap disclosed herein have been described with respect to their compatibility with certain hydration systems, the embodiments of the cap can be interchanged and thus configured to interface with other hydration systems which employ similar designs, and with any of the disclosed bladder couplings.

In certain embodiments, the cap can be fitted with a bladder coupling comprising a sleeve. The sleeve serves as a conduit through which heat and airflow are transported from the heater and/or blower unit into the hydration system as illustrated in FIGS. 2A and 4.

The sleeve can be adhered to the cap using a non-toxic adhesive/glue or epoxy, cold welding, stitching, pressing, or via another similar connective means. In one embodiment, the sleeve can be fitted and sewn to the shape of the cap opening. The sleeve can be fitted over a wooden dowel, which is configured to have the same shape as the sleeve. An adhesive/glue or epoxy can then be applied to the end of the sleeve, ensuring that no adhesive/glue or epoxy is on the wooden dowel, and then inserted into the opening of the cap. Excess adhesive/glue or epoxy can be removed from the interior and exterior of the cap. The wooden dowel will be left in the cap until the adhesive/glue or epoxy is fully dried. The wooden dowel can then be removed leaving the sleeve affixed to the cap.

Other means of fabricating the connection between the sleeve and cap may also be employed according to design considerations. For example, in other embodiments, the sleeve can be attached to the cap via adhesive. The distal end of the sleeve can include a slit and a hook and loop tape band. The hook and loop tape band can be sewn to the top of the sleeve and have a slit to accommodate various sized nozzles associated with, for example a blower, a heater, or a hair dryer. The sleeve thus serves as a conduit between the inside of the bladder and a blower/heater.

The sleeve can be formed from fabric such as cotton, polyester, wool, vinyl or plastic. The sleeve can also be made of semi-rigid polymers, PVCs, metals, wood, or any number of semi-rigid pneumatic hoses capable of being formed into the shape of the cap. In an exemplary embodiment, the sleeve can be formed of 9 oz. cotton fabric, but other fabric types may also be used. This sleeve can optionally include a plain design or one of many designs to include but not limited to, sports teams logos, company names' and US military logos.

The sleeve can be the interface between the cap and the dryer/blower or hair dryer nozzle. One end of the sleeve can be attached to the cap as described above, regardless of the cap system used. The other end of the sleeve can have a wide elastic band, or other such stretchable band sewn into its end. The elastic band can include one or more (preferably four to six) separate tabs integrated therein. In an embodiment, the tabs are sewn to the end of the sleeve. The tabs can be formed of non-toxic plastic, rubber, stiffened cloth, or other such semi rigid materials. The tabs can be configured on the elastic band such that each tab is separate from the adjacent tab, but as a system, the tabs cover the entire sleeve opening. The tabs can be configured as elongated strips that flare out slightly at their ends, although in other embodiments other shapes may be used according to design considerations. The blower/dryer nozzle, or hair dryer nozzle, can be pushed into the sleeve and firmly secured via the elastic band. During exemplary operation of the blower/dryer or hair dryer, heated air is used to dry the bladder and hose system. Once the bladder is dry, the sleeve can be pulled off of the nozzle and stowed until needed again.

Figure 5:
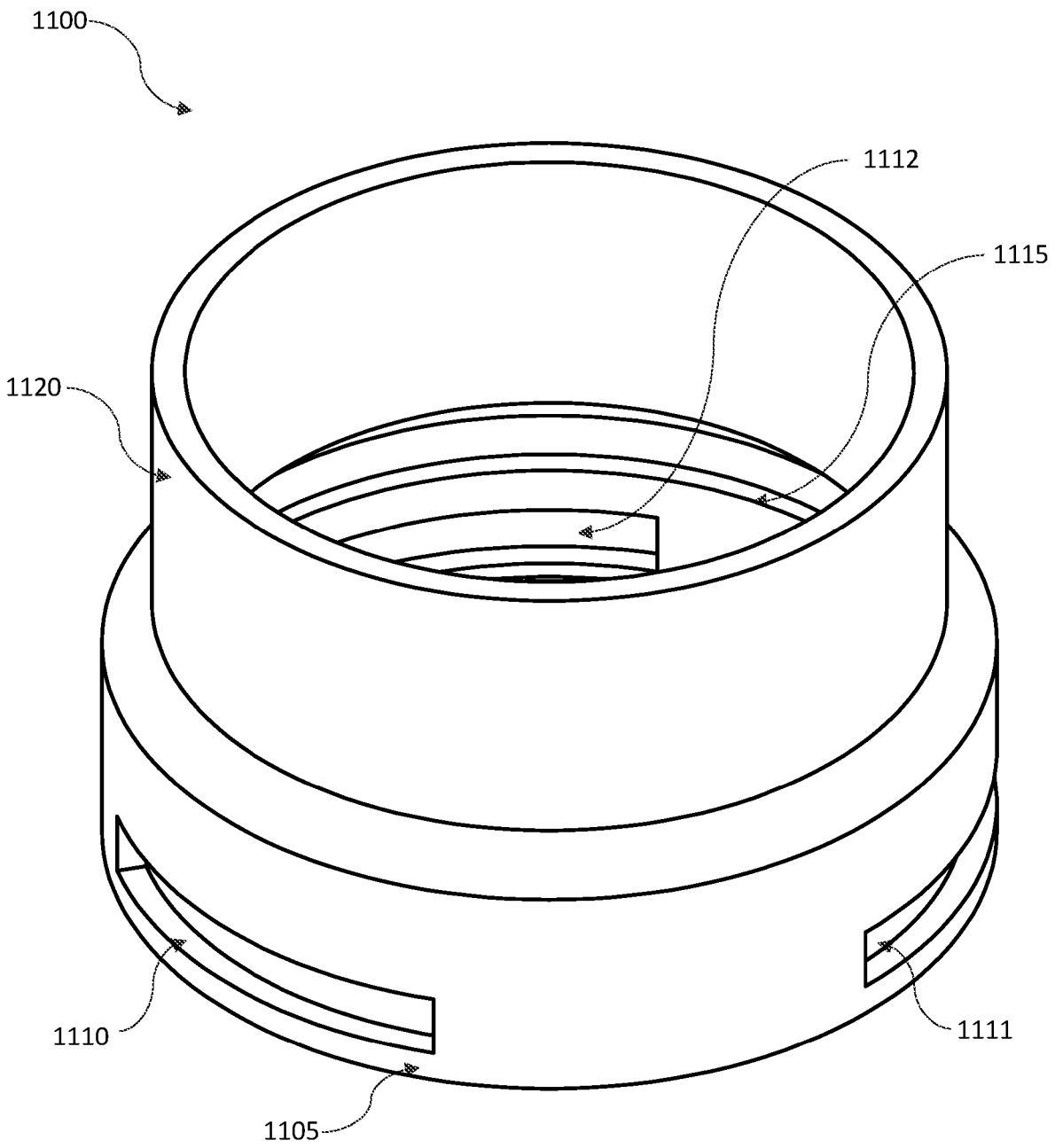
FIG. 5 depicts another embodiment of bladder coupler in accordance with the disclosed embodiments.

In another embodiment, illustrated in FIG. 5 a universal bladder coupling 1100 is shown. The universal bladder coupling 1100 comprises a lower ring 1105 that includes a series of vent slots 1110, 1111, and 1112. The interior of the universal bladder coupling 1100 also includes a rim 1115. The rim 1115 is configured to integrate with a connection rim, such as connection rim 830 shown in FIG. 2G or connection rim 925 shown in FIG. 3.

The universal bladder coupling 1100 includes a conduit 1120 that is connected to the lower ring 1105. The conduit 1120 serves as the interface between the bladder coupling 1100 and the heater/blower.

During use, the bladder coupling 1100 can be connected to a cap. The lower ring 1105 can be twisted such that the vent slots 1110, 1111, and 1112 are aligned, partially aligned, or unaligned with connection fins, such as connection fins 920, 921, and 922, or connection fins 825, 826, and 827. Alignment of the vent slots in reference to the connection fins can be adjusted to allow for inflation of the hydration bladder while maintaining even airflow. In certain embodiments the bladder coupling 1100 can be configured of a rigid or semi-rigid material such as plastic, metal, hard rubber, etc.

Figure 6A:
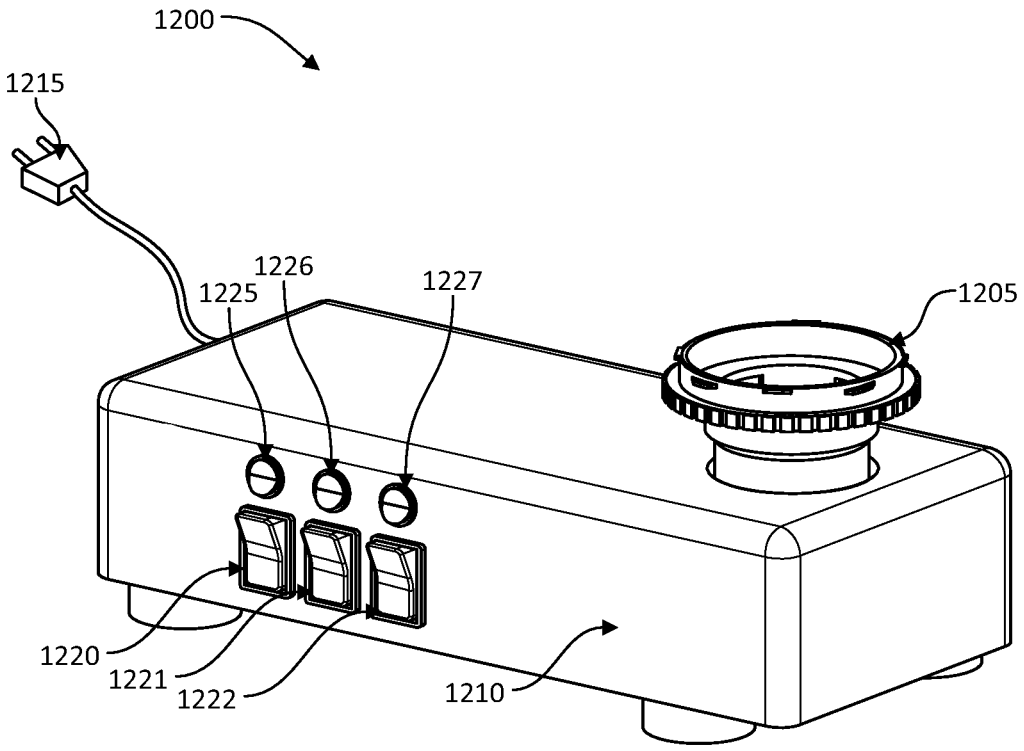
FIG. 6A depicts a heater/blower in accordance with the disclosed embodiments.
Figure 6B:
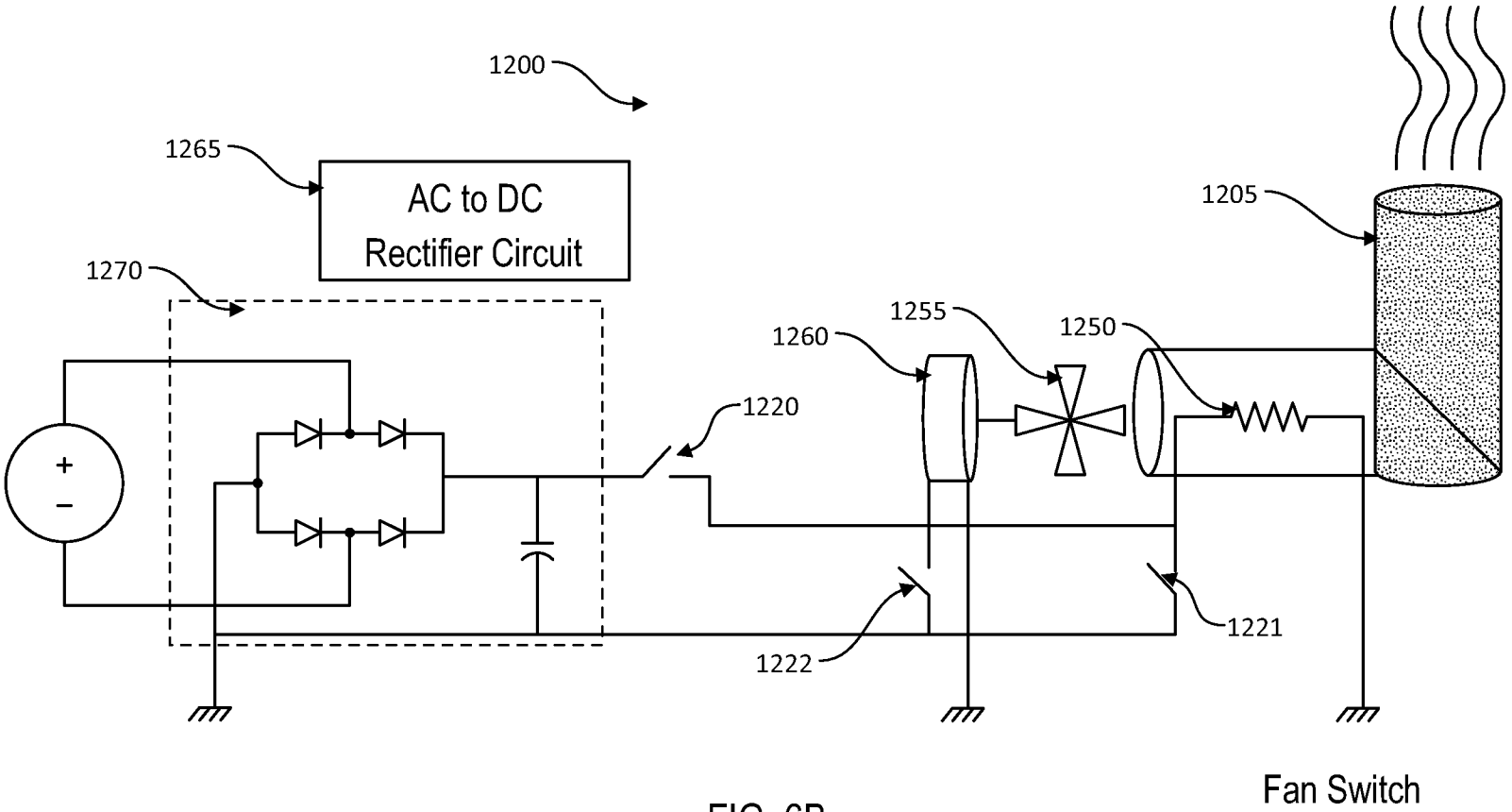
FIG. 6B depicts a system diagram of a heater/blower in accordance with the disclosed embodiments.

The systems disclosed herein can further comprise a warm air blowing apparatus 1200 as illustrated in FIG. 6A, the details of which are provided in FIG. 6B. Generally, the heater/blower 1200 is formed in a case 1210. The case 1210 includes master power switch 1220, and power indicator light 1225, heating element switch 1221, and heater indicator light 1226, and fan switch 1222, and fan indicator light 1227. The case 1210 includes a conduit 1205 that provides a fluidic connection between the heater/blower 1200 and the bladder coupler. The heater/blower can have a power cord 1215 that provides connection to an external power source.

FIG. 6B illustrates a diagram of the elements contained in the case 1210 of the heater/blower 1200. The heater/blower 1200 includes a heating element 1205 such as electric heating coils, and a fan 1255 to blow air heated by the heating coils 1250, through the conduit. The fan motor 1260 that turns the fan 1255, is connected to fan switch 1222. The heating element 1205 is connected to heating element switch 1221. Master power switch 1220 connects the down line components to a power source 1270, which can be connected to an AC to DC rectifier circuit 1265. In certain embodiment the air blowing apparatus can also be battery powered. In some embodiments, the warm air blowing apparatus can comprise a hair dryer.

Figure 7:
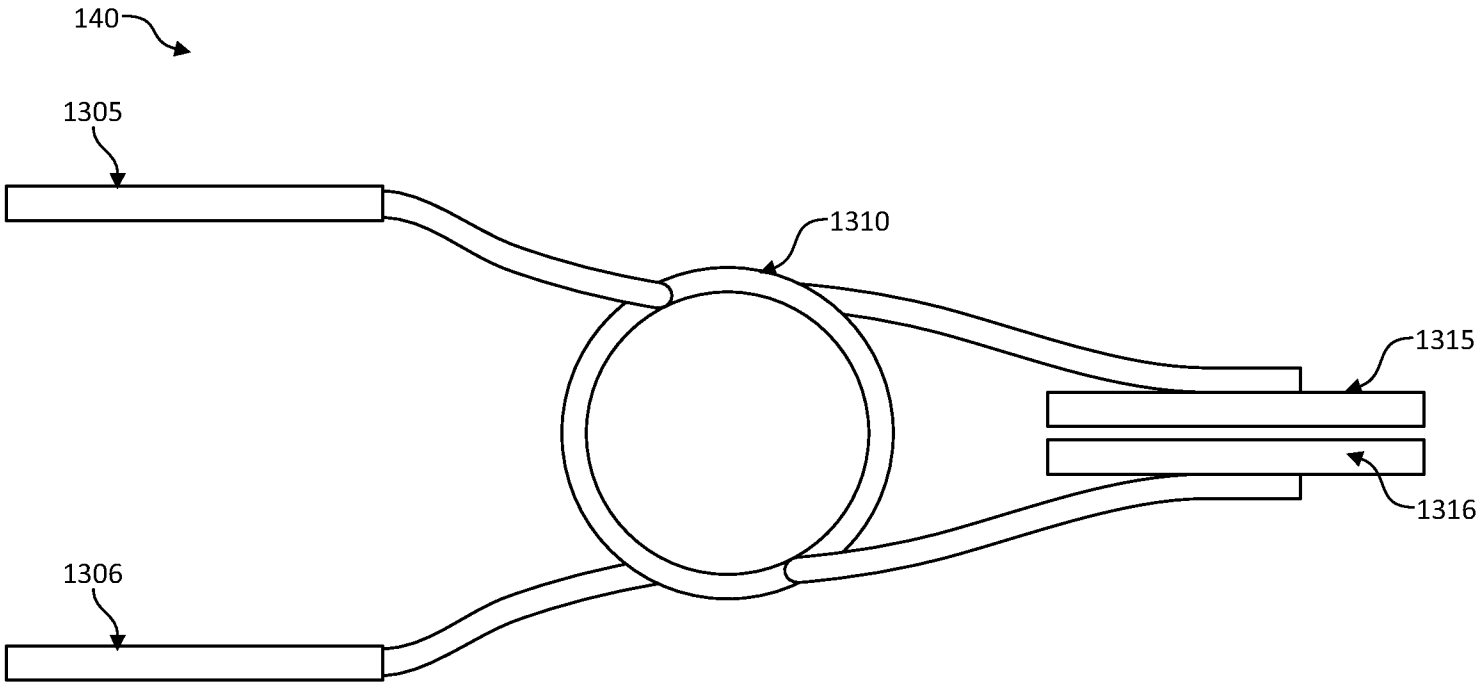
FIG. 7 depicts a clip in accordance with the disclosed embodiments.

The system further includes a clip 140 as shown in FIG. 7. The clip 140 can comprise two large flat retaining members 1305 and 1306 along with a spring coil 1310 to hold the tips 1315 and 1316 of the retaining members together. In certain embodiments other clips, such as a clothespin, can be used according to design consideration.

The clip 140 can be engaged on an end of the hydration system's mouthpiece. The clip 140 can be used to squeeze the mouthpiece into an open position so that air can flow through the tube connecting the mouthpiece to the bladder. The large flat surfaces of the clip 140 are important because they help prevent damage to the mouthpiece. A spring coil 1310 can be used to hold the surfaces of the clip 140 together. The spring coil 1310 preferably applies approximately 2 lbs. of pressure to the mouthpiece, although other pressures may also be used according to design considerations. A small clamp can also be used to hold the mouthpiece open.

Figure 8:
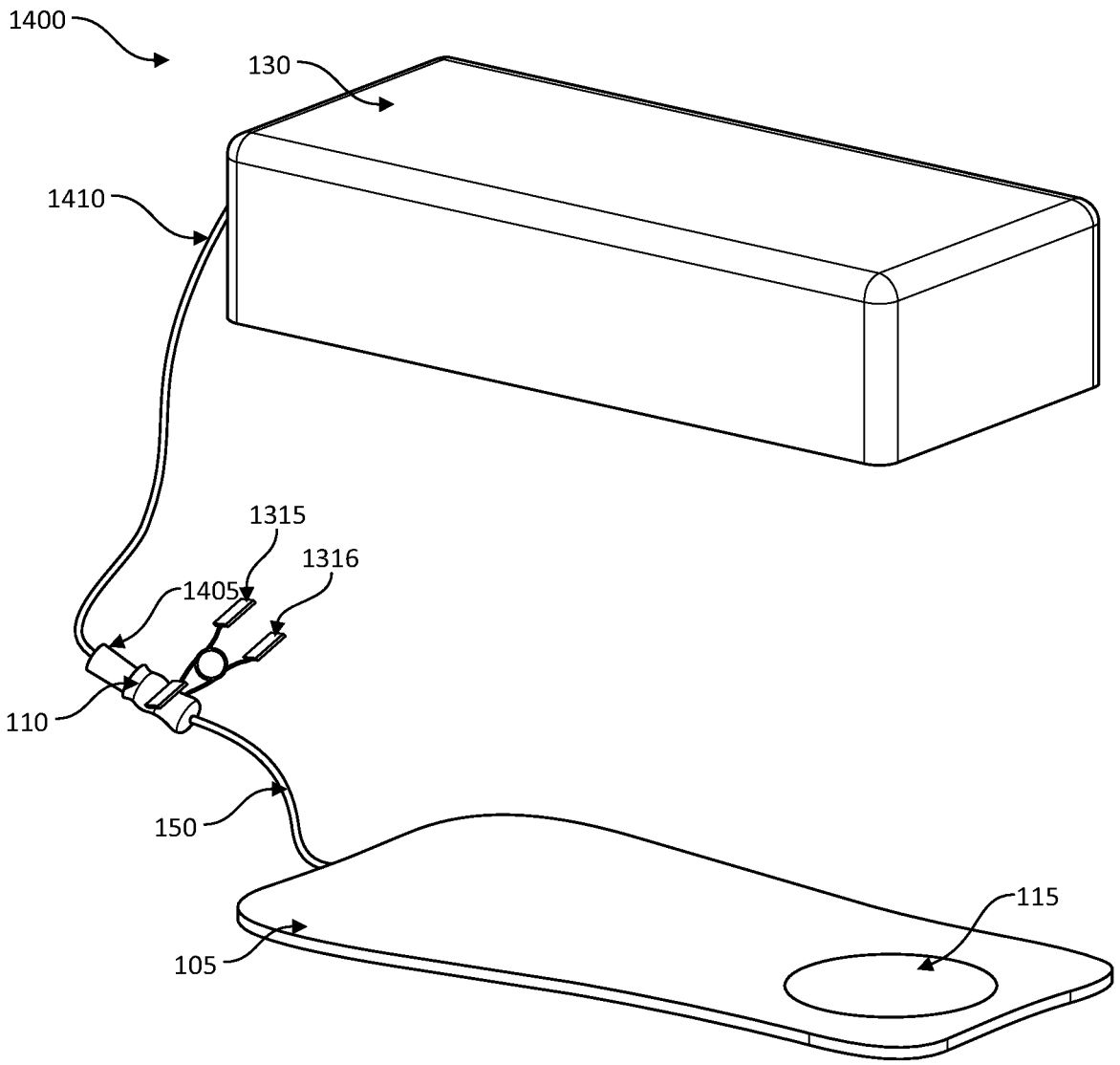
FIG. 8 depicts a block diagram of another embodiment of a drying system for a hydration bladder in accordance with the disclosed embodiments.

In another embodiment, a system 1400 for drying a hydration bladder includes a hose system as illustrated in FIG. 8. A tube 1410 can be formed of plastic, rubber, metal, PVC, or other such material. The tube 1410 can, in certain embodiments, be approximately two feet long although other lengths are also possible according to design considerations. The hose 1410 is fitted with a small non-metal needle instrument 1405 at one end. The needle instrument 1405 is preferably conical and hollow. The other end of the tube 1410 can be tapered out to a prescribed diameter or fitted with a sleeve, as described in the other embodiments.

In such embodiments, the needle ending 1405 can be inserted into the mouthpiece 110 through the mouthpiece opening. The tapered end can be connected to the heater/blower apparatus 130 so that air can be provided through the mouthpiece 110 to the bladder 105 in order to fill the bladder 105. Once full, the hose 1410 can be withdrawn from the mouthpiece 110. The mouthpiece 110 is configured to automatically close. Thus, upon removal of the hose 1410, the bladder 105 remains fully inflated.

The embodiments disclosed herein can further include a variety of rack arrangements for rack 120 that can be constructed from medium gage wire or stiff plastic. The rack 120 can include a plurality of legs formed to hold the platform structure above the surface below (such as a countertop). The rack 120 can have one or more cross struts and can be formed from the same material as the rack 120. The rack 120 can also include clip-on struts to accommodate smaller hydration bladders. Another embodiment of the rack 120 can be tailored in shape and size for a specific bladder system. This rack 120 employs upright struts over which the bladder system can be gently fitted.

For example, in an alternative embodiment of a rack system designed for use with a Platypus® hydration bladder or other substantially similar hydration bladder with large slit type openings, the rack can include a supporting base with horizontal rails. In this embodiment, all the horizontal and vertical rails are stationary. Two vertical supports are further provided, with semicircular shaped rests. In practice, the vertical supports and rests can be inserted into the top or bottom opening of the hydration bladder. In this embodiment, all the horizontal and vertical rails are stationary.

In other embodiments the wire rack that can be adjustable. In particular, the vertical struts can be moved along the horizontal rails. The upright struts can be guided on the horizontal rails via a hinge system. Flipping the hinge towards the upright struts can close them, while flipping the hinge away from the upright struts can open them.

The rack system can include an elevated hold that runs along the open slot. Springs can be formed in the bottom rail assembly so that the springs can pull the struts to an open position and push the struts to a closed position. A lever is provided in the bottom rail assembly to open and close the strut. An opening is provided in the top rail system to allow the lever to operate.

In some embodiments, one of the struts can move while the other remains stationary. This system comprises two rods riding halfway inside each of the outer horizontal rails. One end of each rod will be attached to its respective horizontal rail by way of a spring. Each of the springs, in turn, will be attached to a lever system. The other end of each rod will be attached to the vertical strut. Once the bladder is placed over the "closed" struts, the lever system can be pulled away from the struts. The strut will move along the running slot on the top rail assembly and open the bladder.

The heater/blower system can then be placed under the opening of the bladder, blowing warm air into the bladder without the need of a vent system. It should be understood that the rack system can be used with a Platypus® bladder or any other bladder including bladder systems with an irregular slit type opening, as well as with any standard hydration bladder.

In practice, the systems and methods disclosed herein can be connected to the hydration system by engaging the cap on the bladder. The warm air blowing apparatus can be used to blow hot air, cold air, or warm air throughout the bladder, hose and mouthpiece. The clip can be engaged to the mouthpiece to hold the mouthpiece open so that air can flow throughout the various hydration system components.

Blowing warm air into and through the bladder, hose and mouthpiece, serves two purposes: First, the air inflates, or partially inflates, the bladder and keeps the soft inner surfaces from touching one another, allowing air flow throughout the bladder, hose, and mouthpiece. Second, blowing warm air into the bladder completely dries out the bladder, hose, and mouthpiece quickly and efficiently.

Figure 9:
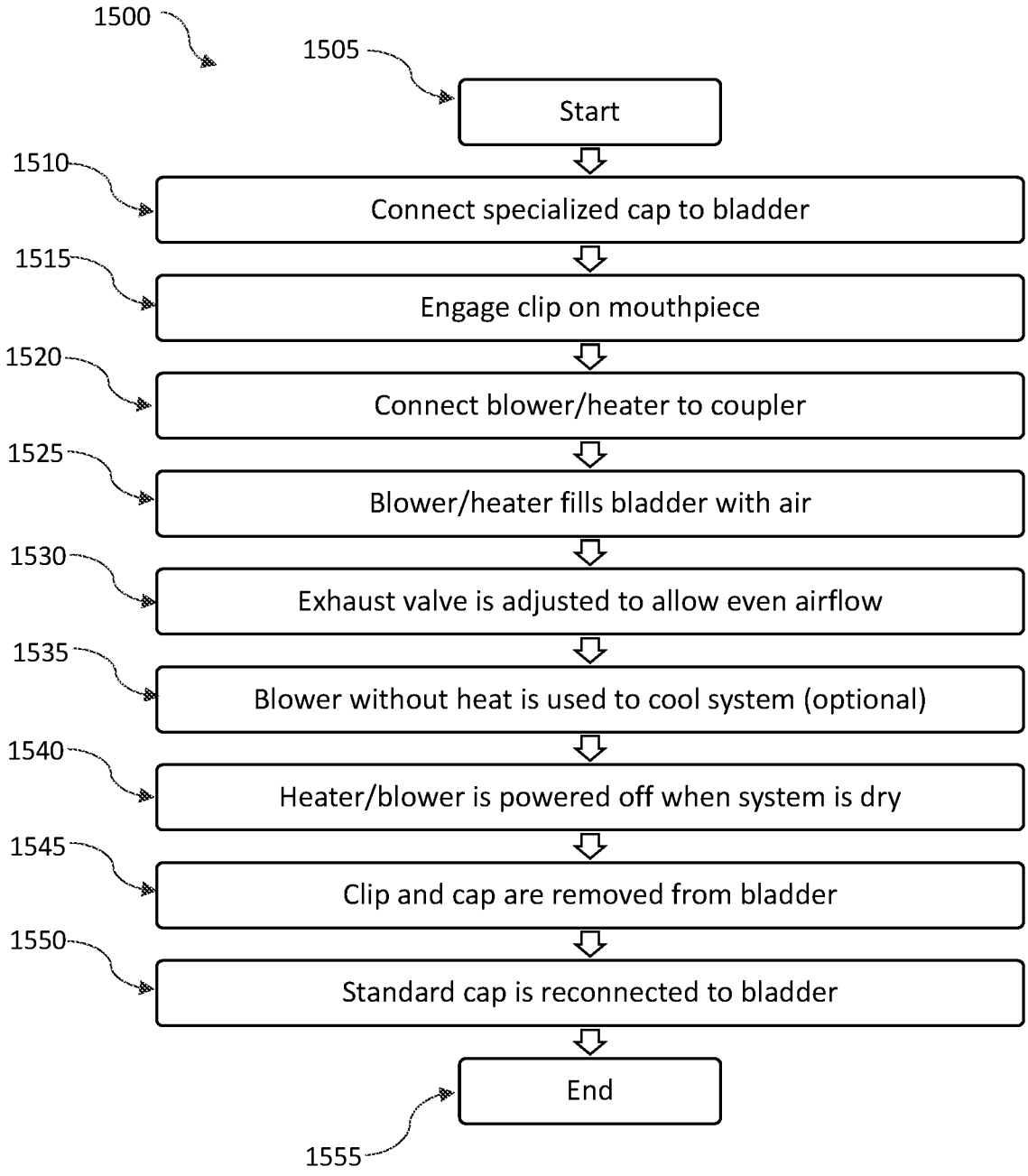
FIG. 9 depicts a flow chart of steps associated with a method for drying a hydration bladder in accordance with the disclosed embodiments.

For example, in one embodiment illustrated in FIG. 9 a method 1500 is illustrated for drying the interior of a bladder. The method begins at 1505. In certain embodiments of the system the specially designed cap can be screwed on to the hydration system bladder at step 1510. The clip can be attached to the mouthpiece to hold the mouthpiece open as illustrated at 1515. The nozzle of the blower/heater system, or in other embodiments, a hair dryer, can be inserted into the coupler and secured as illustrated at 1520. The blower/heater system (or hair dryer) can be turned on. It should be appreciated that the blower/heater system can include switches to adjust fan speed and temperature. In the most common case, the blower/heater unit is set to BLOWER and HEATER, (or the lowest "HEAT" setting for a hair dryer). It should be appreciated that in other cases other settings may be used. At step 1525 the blower/heater provides airflow into the bladder and inflates, or partially inflates, the bladder.

Once the bladder is inflated, the exhaust valve can be adjusted at step 1530 to allow air to escape and maintain an even flow into and out of, the bladder and mouthpiece. If a hair dryer is used, special attention must be taken to ensure the heat and blower setting of the hair dryer are not set high enough to melt the vinyl, plastic, or rubber parts of the bladder and hose.

Once the bladder is dry, in some embodiments the heater switch can be turned off, using only the blower to cool off the bladder, if desired, as shown at 1535. Finally, the heater/blower can be turned off, as illustrated at 1540, and the specialized cap can be removed and replaced with the bladder's normal cap. The clip on the mouthpiece can also be removed as shown at 1545. The standard cap can then be replaced at 1550, and the hydration system is in condition for storage or use. The method ends at 1555.

Figure 10:
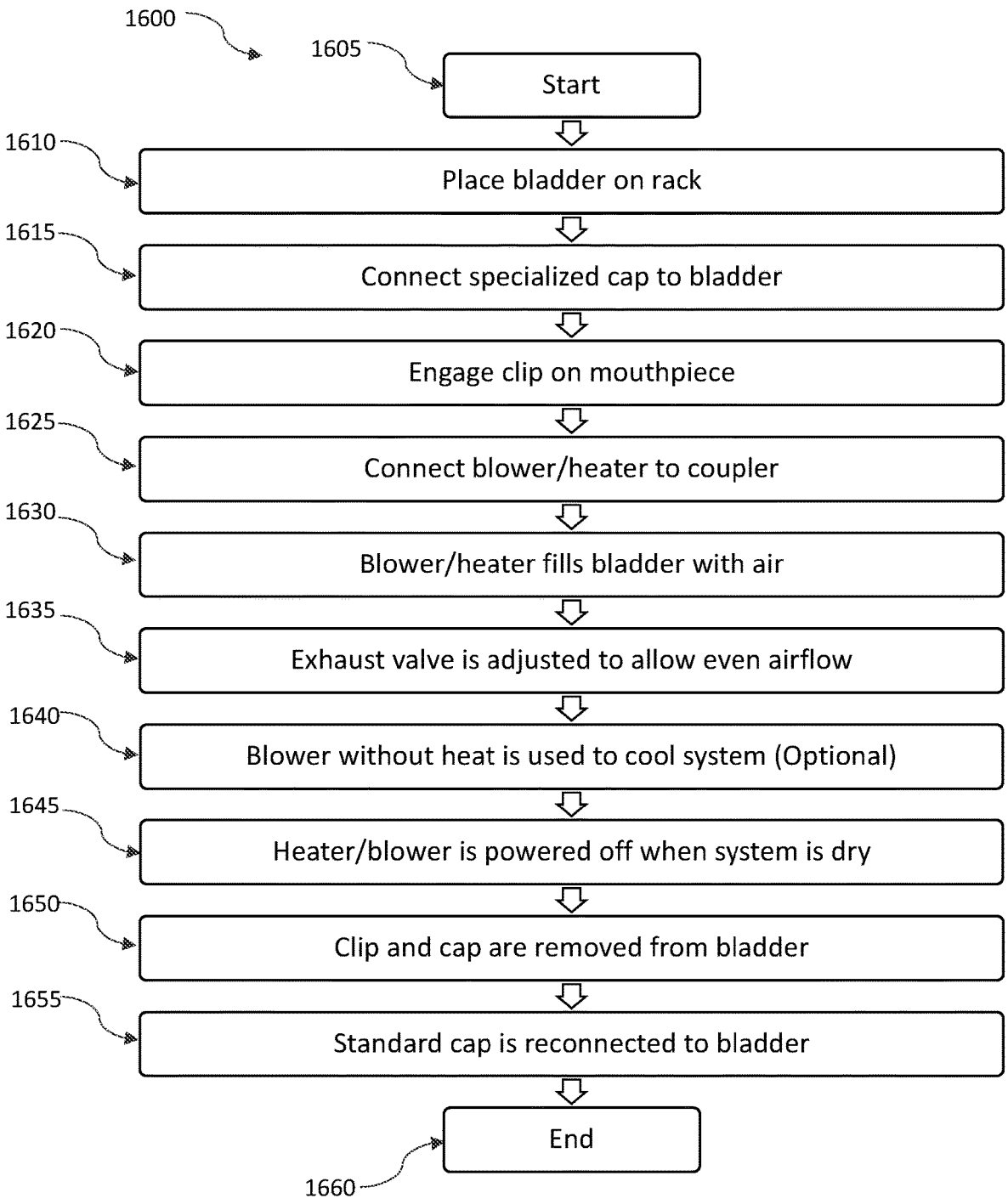
FIG. 10 depicts a flow chart of steps associated with a method for drying a hydration bladder in accordance with the disclosed embodiments.

In another embodiment, illustrated in FIG. 10, a method 1600 for drying the interior of a bladder is provided. The method begins at 1605. In this embodiment, the bladder is placed on the rack as shown at 1610, with the cap opening in the bladder facing down. The specialized cap can be connected to the bladder at 1615 and the clip is once again applied to the mouthpiece to hold it in an open position at 1620. The heater/blower unit (or hair dryer) can be placed beneath the wire rack. Once the specialized cap is connected to the fitting in the bladder, the coupler can be connected to the heater/blower unit's nozzle (or the nozzle of a hair dryer) as shown at 1625.

As before, the blower/heater system (or Hair Dryer) can be turned on. It should be appreciated that the blower/heater system can include switches to adjust fan speed and temperature. In the most common case, the blower/heater unit is set to blower and heater, (or the lowest "heat" setting for a hair dryer). It should be appreciated that in other cases other settings may be used. The blower/heater provides airflow into the bladder and inflates or partially inflates the bladder as shown at 1630.

At this point, the exhaust valve can be adjusted, as shown at 1635, to allow air to escape and maintain an even flow into and out of the bladder and mouthpiece. Once the bladder is dry, the heater switch can optionally be turned off, and the blower can be used by itself if needed to cool the bladder as shown at 1640. Finally, the heater/blower can be turned off at 1645, and the specialized cap and clip can be removed from the bladder as shown at 1650 and replaced by the stock cap 1655. The method ends at 1660.

Figure 11:
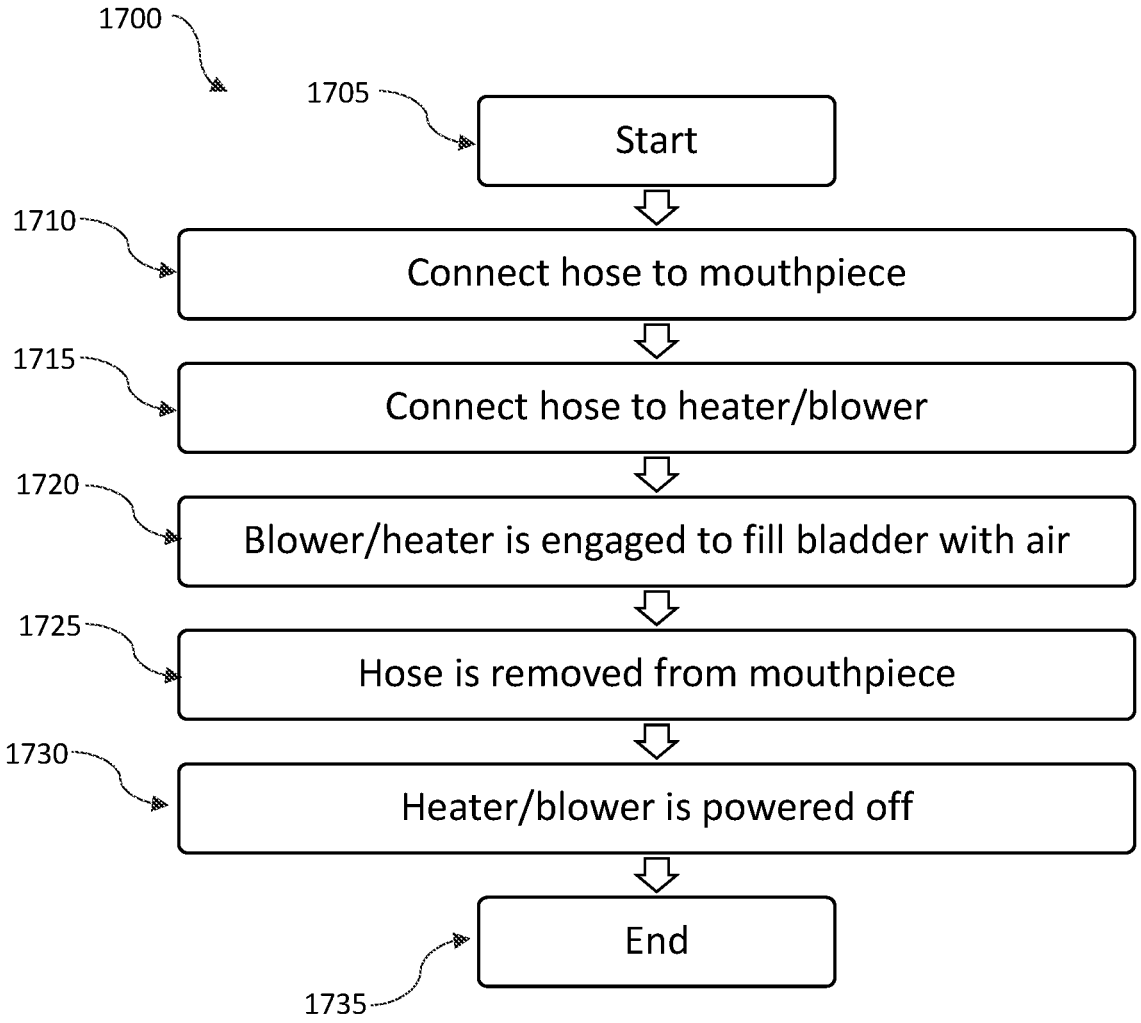
FIG. 11 depicts a flow chart of steps associated with a method for drying a hydration bladder in accordance with the disclosed embodiments.

In yet another embodiment, a method 1700 for drying the interior of a bladder illustrated is illustrated FIG. 11, where the systems described herein can be used to inflate the bladder. The method begins at 1705. At step 1710, a hose with a specialized needle end can be inserted in the mouthpiece, and a tapered end can be attached to the blower/heater system at step 1715.

The heater/blower can then blow air through the mouthpiece into the bladder until it is inflated as shown at step 1720. Preferably, cool air is used to prevent melting the components of the hydration system but in other cases, warm or hot air may also be used. Once the bladder is inflated the plastic hose can be removed from the mouthpiece as shown at 1725, which is configured to close automatically when it is not squeezed. The blower/heater system is also turned off at step 1730. The bladder can be kept inflated for a desired amount of time. Keeping the bladder system inflated helps keep the bladder clean and mold free. The method ends at 1735.

Figure 12:
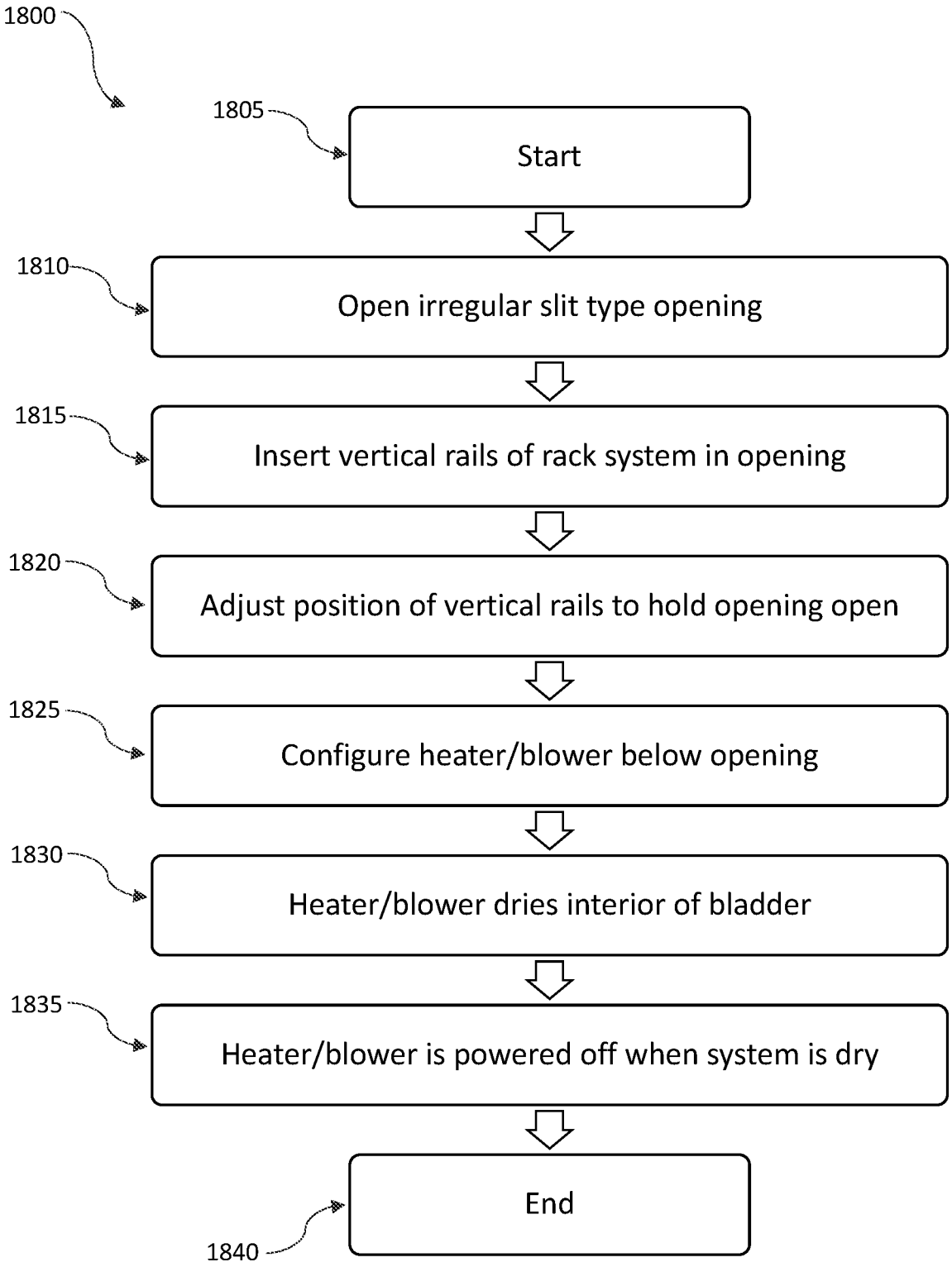
FIG. 12 depicts a flow chart of steps associated with a method for drying a hydration bladder in accordance with the disclosed embodiments.

FIG. 12 describes a method 1800 for drying a Platypus® type bladder, or other such bladder including bladder systems with an irregular or slit type opening. The method starts at 1805. In such an embodiment, the opening of the bladder can be opened, and the bladder can be placed on the rack system described herein as shown at 1810. The mouth of the bladder (even if it is irregular and flexible) can be placed over the rack system as illustrated at 1815. The position of the vertical rails can be adjusted, as shown at 1820, to ensure the opening is optimally opened. The heater/blower unit can then be placed under the bladder as shown at 1825. The heater/blower system will then be turned "ON", and warm air will be blown into the bladder to dry out the interior surfaces of the bladder, as shown at 1830. The heater/blower unit can be powered off as shown at 1835 when the interior surfaces are dry at which point the method ends at 1840.

It should be appreciated that in other embodiments the system can be adapted to other bladder systems that are required to be stored dry to prevent mold or other harmful contamination. For example, large bladder systems, such as those used by the US military for potable water, could be serviced according to the systems and methods disclosed herein. Such potable water systems use a larger version of the bladder and are used in Forward Operational Bases (FOBs). The same potable water systems, using larger bladders, are used by FEMA and USAID in areas struck by famine or by natural disaster. All such bladder systems could be prepared for storage according to the systems and methods disclosed herein.

Figure 13A:
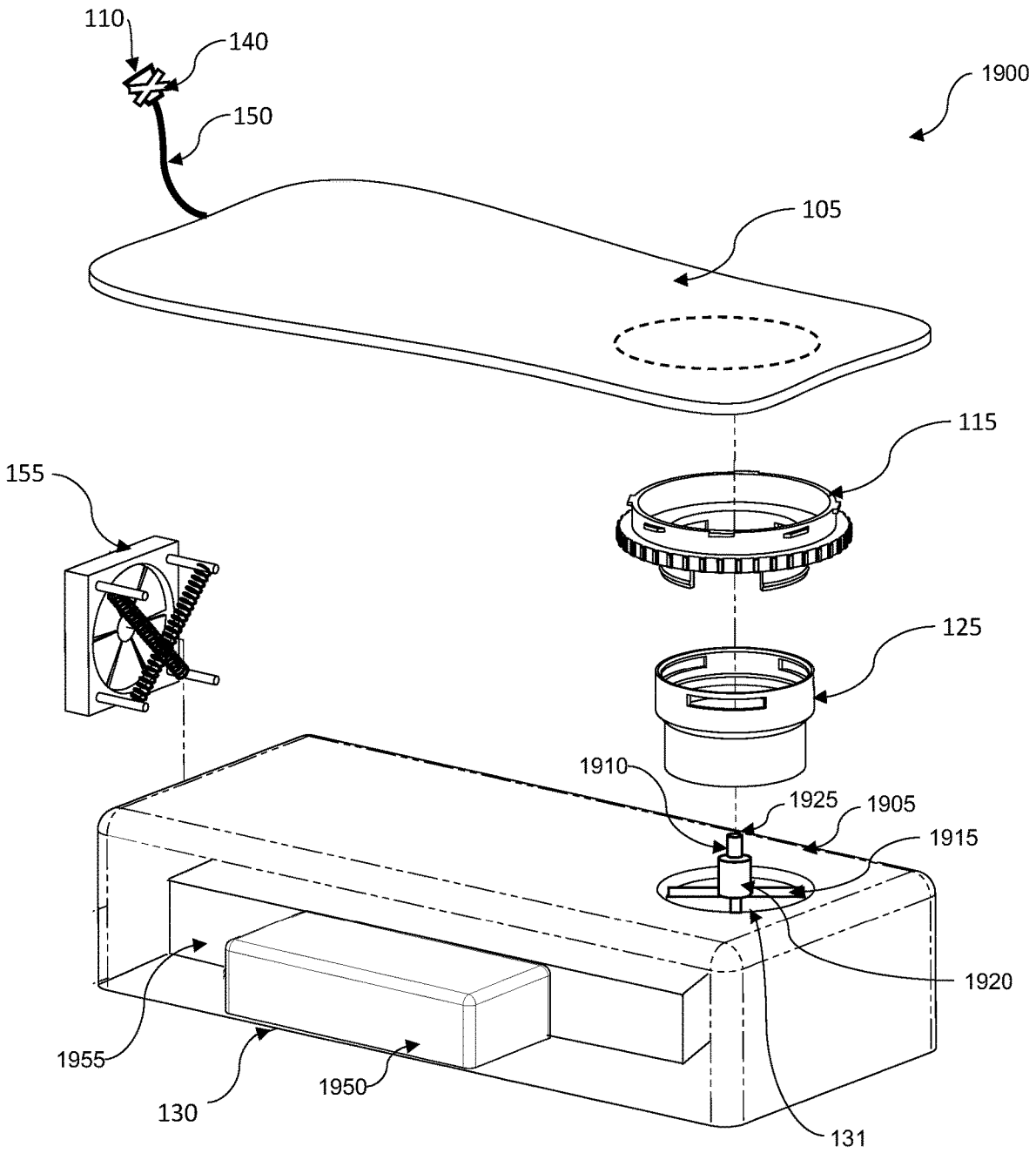
FIG. 13A depicts a block diagram of a drying system for a hydration bladder incorporating a ultraviolet light source and an ozone generator, in accordance with the disclosed embodiments.
Figure 13B:
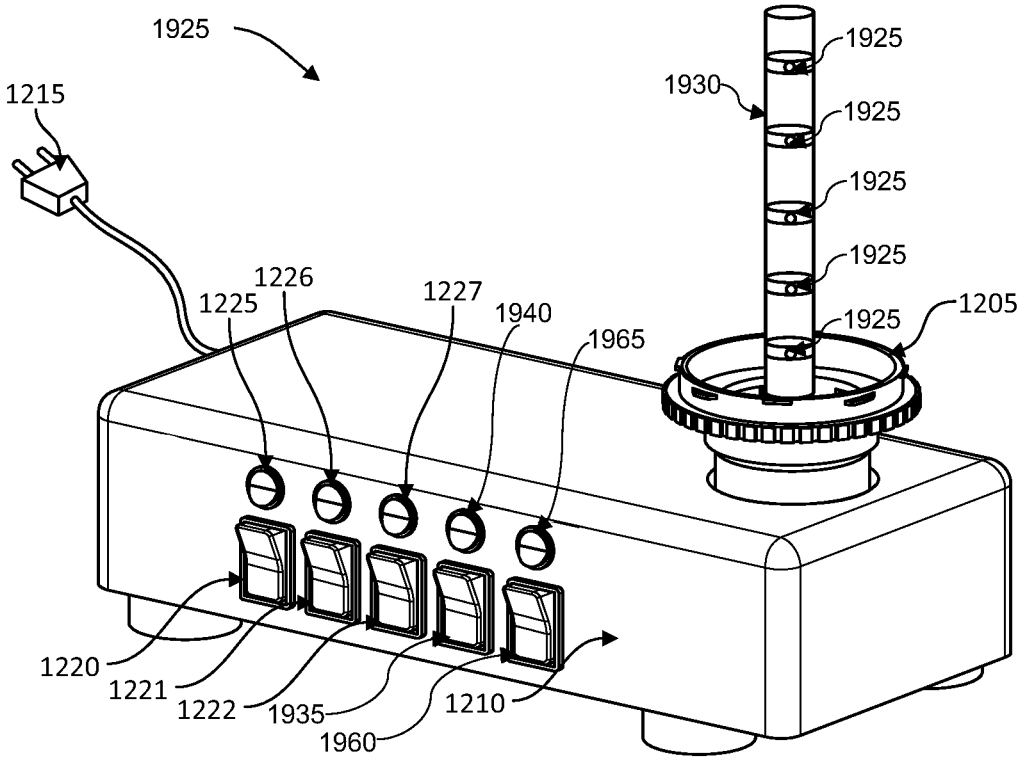
FIG. 13B depicts a block diagram of a drying system for a hydration bladder incorporating a ultraviolet light source and an ozone generator, in accordance with the disclosed embodiments

FIGS. 13A and 13B illustrate additional embodiments of the system 1900 disclosed herein. The system 1900 can incorporate features of other embodiments disclosed. The system 1900 includes a light source assembly 1905 and an ozone generator 1950.

The light source assembly 1905 can comprise an ultraviolet (UV) light source 1910, mounted to a mounting bracket 1915 configured in the opening 131 of the heater and/or blower unit 130. The light source assembly 1905 can be configured to expose various pathogenic particles in the hydration bladder, balder tubing, and or mouthpiece to ultraviolet light. The UV light source 1905 can comprise a driver 1920. The diver is connected to a power source, which can include the power supply provided to the system 1900. The driver 1920 can drive one or more UV lights 1925 configured on the UV light source 1910. In certain embodiments, the UV light source 1910 can comprise a string of UV lights 1925 installed in and or on a flexible tubing 1930. The flexible tubing 1930 can be used to provide the light to various locations within the hydration system.

The system 1900 can further include a ozone generator 1950 configured in the heater and/or blower unit 130. The ozone generator 1950 can be configured to provide an electric discharge. The electric discharge within the ozone generator can split the 02 molecules in the air into single oxygen molecules. These atoms can then attach to other $O_2$ molecules forming ozone ($O_3$). Ozone within the ozone generator can then be forced out of the ozone generator and into flume 1955, where it flows into the hydration system. The ozone can be used to treat mold, bacteria, or other volatile organic compounds in the hydration bladder. The ozone may further be used to remove odors in the hydration system.

In other embodiments, ozone generation can be accomplished using other methods, including the use of ultraviolet radiation to split $O_2$ to form individual oxygen atoms. In such embodiments, an ultraviolet source can be provided in the ozone generator 1950.

As illustrated in FIG. 13B, a switch 1935 can be provided to activate the light source assembly 1905. An indicator light 1940 can be provided to show when the light source is active. Likewise, a switch 1960 can be provided to activate the ozone generator, and indicator light 1965 can identify when the ozone generator is active.

Based on the foregoing, it can be appreciated that a number of embodiments, preferred and alternative, are disclosed herein. For example, in an embodiment, a system comprises an airflow apparatus, a cap for a bladder the cap comprising a fluidic connection to the bladder and the air flow apparatus, a conduit connected to the cap and the airflow apparatus, and a clip connected to a mouthpiece associated with the bladder wherein the airflow apparatus produces airflow through the bladder and the mouthpiece.

In certain embodiments the airflow apparatus further comprises a heat element and a fan. In another embodiment the airflow apparatus further comprises a hair dryer.

In another embodiment the cap further comprises an exhaust vent. The size of an opening associated with the exhaust vent can be adjusted. In an embodiment the conduit further comprises an exhaust vent. The size of an opening associated with the exhaust vent in the conduit can be adjusted.

In an embodiment the conduit further comprises a slit end and a fastening member wherein the slit end and fastening member allow the diameter of the conduit to be adjusted.

In an embodiment, the system further comprises a rack configured to hold the bladder while the airflow flows through the bladder and the mouthpiece.

In another embodiment a system comprises an airflow apparatus comprising a case, a heating element, and a fan, a cap for a hydration bladder the cap comprising a fluidic connection to the bladder and the air flow apparatus, a conduit connected to the cap and the airflow apparatus, the conduit further comprising an exhaust vent, a clip connected to a mouthpiece associated with the bladder wherein the airflow apparatus produces airflow through the bladder and the mouthpiece, and a rack configured to hold the hydration bladder while airflow flow through the bladder and the mouthpiece. In an embodiment the cap further comprises an exhaust vent wherein a size of an opening associated with the exhaust vent can be adjusted.

In yet another embodiment, a hydration system drying apparatus comprises: an airflow apparatus, a cap for a bladder the cap comprising a fluidic connection to the bladder and the air flow apparatus, a conduit connected to the cap and the airflow apparatus, and a clip connected to a mouthpiece associated with the bladder wherein the airflow apparatus produces airflow through the bladder and the mouthpiece.

In an embodiment the airflow apparatus further comprises a heat element and a fan. In another embodiment the airflow apparatus further comprises a hair dryer.

In an embodiment the cap further comprises an exhaust vent wherein a size of an opening associated with the exhaust vent can be adjusted.

In another embodiment the conduit further comprises an exhaust vent. The size of an opening associated with the exhaust vent can be adjusted.

In an embodiment, the conduit further comprises a slit end and a fastening member wherein the slit end and fastening member allow the diameter of the conduit to be adjusted.

In an embodiment the apparatus further comprising a rack configured to hold the bladder while the airflow flows through the bladder and the mouthpiece.

In another embodiment, a system comprises an airflow apparatus, a cap for a bladder, the cap comprising a fluidic connection to the bladder and the air flow apparatus, a light source assembly configured in the opening of the airflow apparatus. In an embodiment, the airflow apparatus further comprises an ozone generator. In an embodiment, the airflow apparatus further comprises a heat element and a fan.

In an embodiment, the cap further comprises an exhaust vent, the exhaust vent comprises an inner cap, an outer cap engaged to the inner cap, and at least one opening in the outer cap, and at least one opening in the inner cap, wherein rotation of the inner cap with respect to the outer cap aligns the at least one opening in the outer cap with the at least one opening in the inner cap. In an embodiment, the size of the exhaust vent can be adjusted by rotation of the inner cap with respect to the outer cap.

In an embodiment, the light source further comprises: a tube, a driver, and at least one light source configured on the tube. In an embodiment, the light source further comprises an ultraviolet light source.

In another embodiment, a system comprises an airflow apparatus, a cap for a bladder, the cap comprising a fluidic connection to the bladder and the air flow apparatus, and an ozone generator configured in the airflow apparatus. In an embodiment, the airflow apparatus further comprises an ultraviolet light source. In an embodiment, the airflow apparatus further comprises a heat element and a fan.

In an embodiment, the further comprises an exhaust vent, the exhaust vent comprising an inner cap, an outer cap engaged to the inner cap, and at least one opening in the outer cap, and at least one opening in the inner cap, wherein rotation of the inner cap with respect to the outer cap aligns the at least one opening in the outer cap with the at least one opening in the inner cap. In an embodiment, the size of the exhaust vent can be adjusted by rotation of the inner cap with respect to the outer cap.

In an embodiment, the system further comprises a flume configured to deliver fluid to an opening in the airflow apparatus, wherein the ozone generator is in fluidic connection with the flume.

In an embodiment, a system comprises an airflow apparatus comprising a case, a heating element, an opening and a fan; a cap for a hydration bladder, the cap comprising a fluidic connection to the bladder and the air flow apparatus; an exhaust vent formed in the cap from which gas in the hydration bladder can exit the hydration bladder; a light source assembly configured at the opening of the airflow apparatus; and an ozone generator configured in the airflow apparatus. In an embodiment, the light source assembly further comprises a tube; a driver; and at least one light source configured on the tube. In an embodiment, the light source assembly further comprises a mounting bracket mounted in the opening of the airflow apparatus. In an embodiment, the light source further comprises an ultraviolet light source. In an embodiment, the system further comprises a flume configured to deliver fluid to an opening in the airflow apparatus, wherein the ozone generator is in fluidic connection with the flume. In an embodiment, the ozone generator comprises a corona discharge ozone generator. In an embodiment, the ozone generator comprises a ultraviolet light ozone generator.

It will be appreciated that variations of the above-disclosed and other features and functions, or alternatives thereof, may be desirably combined into many other different systems or applications. Furthermore, it can be appreciated that various presently unforeseen or unanticipated alternatives, modifications, variations or improvements therein may be subsequently made by those skilled in the art which are also intended to be encompassed by the following claims.

What is claimed is:

1. A system comprising:

an airflow apparatus;

a cap for a bladder, the cap comprising threads for engaging a fitting in the bladder, the cap further configured to fit in an opening in the airflow apparatus and form a pneumatic connection between the bladder and the air flow apparatus;

a light source assembly configured on a mounting bracket within the opening of the airflow apparatus, wherein a light on the light source assembly extends through the pneumatic connection into the bladder.

2. The system of claim 1 wherein the airflow apparatus further comprises:

an ozone generator.

3. The system of claim 1 wherein the airflow apparatus further comprises:

a heat element; and a blower.

4. The system of claim 1 wherein the cap further comprises an exhaust vent from which gas in the bladder can exit the bladder, the exhaust vent comprising:

an inner cap;

an outer cap engaged to the inner cap; and at least one opening in the outer cap, and at least one opening in the inner cap, wherein rotation of the inner cap with respect to the outer cap aligns at least one opening in the outer cap with the at least one opening in the inner cap.

5. The system of claim 4 wherein a size of the exhaust vent can be adjusted by rotation of the inner cap with respect to the outer cap.

6. The system of claim 1 wherein the light source assembly further comprises:

a flexible tube configured to be inserted in the bladder;

a driver; and at least one light source configured on the tube.

7. The system of claim 6 wherein the light source further comprises:

an ultraviolet light source.

8. A system comprising:

an airflow apparatus;

a cap for a bladder, the cap comprising threads for engaging a fitting in the bladder, the cap further configured to fit in an opening in the airflow apparatus and form a pneumatic connection between the bladder and the air flow apparatus;

an ozone generator configured in a body of the airflow apparatus, wherein the airflow apparatus is configured to deliver ozone generated by the ozone generator to the bladder via the cap.

9. The system of claim 8 wherein the airflow apparatus further comprises:

an ultraviolet light source.

10. The system of claim 8 wherein the airflow apparatus further comprises:

a heat element; and a fan.

11. The system of claim 8 wherein the cap further comprises an exhaust vent from which gas in the bladder can exit the bladder, the exhaust vent comprising:

an inner cap;

an outer cap engaged to the inner cap; and at least one opening in the outer cap, and at least one opening in the inner cap, wherein rotation of the inner cap with respect to the outer cap aligns the at least one opening in the outer cap with the at least one opening in the inner cap.

12. The system of claim 11 wherein a size the exhaust vent can be adjusted by rotation of the inner cap with respect to the outer cap.

13. The system of claim 8 further comprising:

a flume configured in the body of the airflow apparatus to deliver ozone to an opening in the airflow apparatus, wherein the ozone generator is in pneumatic connection with the flume.

14. A system comprising:

an airflow apparatus comprising a case, a heating element, an opening and a blower;

a cap for a hydration bladder, the cap comprising threads for engaging a fitting in the bladder, the cap further configured to fit in the opening in the airflow apparatus and form a pneumatic connection between the bladder and the air flow apparatus;

an exhaust vent formed in the cap from which gas in the hydration bladder can exit the hydration bladder;

a light source assembly configured at the opening of the airflow apparatus; and a separate ozone generator configured inside the airflow apparatus.

15. The system of claim 14 wherein the light source assembly further comprises:

a flexible tube configured to be inserted in the bladder;

a driver; and at least one light source configured on the tube.

16. The system of claim 15 wherein the light source assembly further comprises:

a mounting bracket mounted in the opening of the airflow apparatus.

17. The system of claim 16 wherein the ozone generator comprises a corona discharge ozone generator.

18. The system of claim 15 wherein the light source further comprises:

an ultraviolet light source.

19. The system of claim 14 further comprising:

a flume configured in the body of the airflow apparatus to deliver ozone to the opening in the airflow apparatus, wherein the ozone generator is in pneumatic connection with the flume.

20. The system of claim 14 wherein the ozone generator comprises an ultraviolet light ozone generator.

* * * * *